US011178972B2

(12) United States Patent
Ballendat et al.

(10) Patent No.: US 11,178,972 B2
(45) Date of Patent: Nov. 23, 2021

(54) CHAIR WITH SEAT TILT MECHANISM

(71) Applicant: BOCK 1 GMBH & CO. KG, Postbauer-Heng (DE)

(72) Inventors: Martin Ballendat, Braunau am Inn (AT); Hermann Bock, Pyrbaum (DE)

(73) Assignee: BOCK 1 GmbH & Co. KG, Postbauer-Heng (DE)

( * ) Notice: Subject to any disclaimer, the term of this patent is extended or adjusted under 35 U.S.C. 154(b) by 0 days.

(21) Appl. No.: 16/878,788

(22) Filed: May 20, 2020

(65) Prior Publication Data

US 2020/0367655 A1 Nov. 26, 2020

(30) Foreign Application Priority Data

May 20, 2019 (DE) ..... 102019113357
May 20, 2019 (DE) ..... 102019113369

(51) Int. Cl.

| | |
|---|---|
| ***A47C 1/024*** | (2006.01) |
| ***A47C 3/026*** | (2006.01) |
| ***A47C 7/00*** | (2006.01) |
| ***A47C 7/56*** | (2006.01) |

(52) U.S. Cl.

CPC ..... *A47C 7/566* (2013.01); *A47C 7/004* (2013.01)

(58) Field of Classification Search

CPC ..... A47C 1/03255; A47C 1/03266; A47C 1/03261; A47C 1/03274; A47C 7/566; A47C 7/004

USPC ..... 297/300.4

See application file for complete search history.

(56) References Cited

U.S. PATENT DOCUMENTS

| | | | | |
|---|---|---|---|---|
| 4,236,752 | A * | 12/1980 | Mizelle | A47C 3/0252 297/302.3 |
| 5,871,258 | A * | 2/1999 | Battey | A47C 1/03255 297/317 |
| 6,439,661 | B1 * | 8/2002 | Brauning | A47C 1/03274 297/300.2 |
| 6,945,602 | B2 * | 9/2005 | Fookes | A47C 1/03277 297/300.4 |
| 7,048,335 | B2 * | 5/2006 | Norman | A47C 1/023 297/300.1 |
| 8,348,341 | B2 * | 1/2013 | Hsiao | A47C 1/03255 297/300.4 |
| 9,033,421 | B2 * | 5/2015 | Wilkinson | A47C 1/03 297/452.64 |

(Continued)

FOREIGN PATENT DOCUMENTS

WO 2017029409 A1 2/2017

*Primary Examiner* — Shin H Kim
(74) *Attorney, Agent, or Firm* — Laurence A. Greenberg; Werner H. Stemer; Ralph E. Locher

(57) ABSTRACT

A chair, in particular an office chair, has a seat inclination mechanism. A transverse strut of the seat inclination mechanism forms a spring device and this spring device has at least one torsion element. The seat inclination mechanism further has a basic support on which a backrest support and a seat element support are articulated. The transverse strut of the seat inclination mechanism forms a spring device. The transverse strut extends in the chair transverse direction and wherein the spring device has at least one torsion element, in particular a torsion bar spring. The torsion element, together with the basic support and/or the backrest support and/or the seat element support, is formed integrally, in particular in one piece, from plastic.

16 Claims, 26 Drawing Sheets

(56) References Cited

U.S. PATENT DOCUMENTS 9,661,930 B2 * 5/2017 Norman ..... A47C 7/24
9,801,471 B2 * 10/2017 Machael ..... A47C 1/03255
10,321,763 B2 * 6/2019 Bonneywell ..... A47C 7/14
10,624,457 B2 * 4/2020 Schmitz ..... A47C 1/03277
2002/0180252 A1 * 12/2002 Kinoshita ..... A47C 3/30
297/463.1
2003/0075961 A1 * 4/2003 Struppler ..... A47C 1/03255
297/300.5
2003/0107251 A1 * 6/2003 Wu ..... A47C 1/03255
297/300.4
2004/0245828 A1 * 12/2004 Norman ..... A47C 7/46
297/300.4
2005/0035638 A1 * 2/2005 Pennington ..... A47C 7/46
297/300.2
2005/0146185 A1 * 7/2005 Fookes ..... A47C 1/03294
297/300.4
2005/0275269 A1 * 12/2005 Fookes ..... A47C 1/03266
297/362
2006/0006715 A1 * 1/2006 Chadwick ..... A47C 7/282
297/300.4
2006/0175884 A1 * 8/2006 Jenkins ..... A47C 3/18
297/300.4
2007/0222265 A1 * 9/2007 Machael ..... A47C 1/03266
297/300.2
2008/0001453 A1 * 1/2008 Rutman ..... A47C 1/03274
297/300.4
2008/0088163 A1 * 4/2008 Sander ..... A47C 1/03255
297/300.4
2008/0290712 A1 * 11/2008 Parker ..... A47C 7/14
297/354.11
2009/0212617 A1 * 8/2009 Krob ..... A47C 1/03255
297/316
2010/0109402 A1 * 5/2010 Masunaga ..... A47C 1/03238
297/300.4
2012/0025574 A1 * 2/2012 Wilkinson ..... A47C 7/282
297/300.1
2014/0125104 A1 * 5/2014 Hasegawa ..... A47C 1/03277
297/303.4
2018/0213939 A1 * 8/2018 Schmidt ..... A47C 7/443
2020/0367655 A1 * 11/2020 Ballendat ..... A47C 7/004

* cited by examiner

CHAIR WITH SEAT TILT MECHANISM

BACKGROUND OF THE INVENTION

Field of the Invention

The invention relates to a chair, in particular an office chair, having the features of the preamble of the independent office chair patent claim and to a seat inclination mechanism having the features of the preamble of the independent seat inclination mechanism patent claim.

Such a chair is sufficiently well known and is regularly used as an office chair which can be adapted to a user in terms of seat height and inclination behavior. The known chair comprises a base frame having a rolling cross and having a base column on which a basic support with a seat element and a seat backrest is mounted. The base column is height-adjustable, with the result that the height of the seat unit can be set. The seat inclination mechanism is formed in such a way that the seat backrest can be tilted or inclined in the vertical direction. Here, the seat inclination mechanism comprises a spring which preloads the seat backrest in such a way that it is positioned in a front end position. When the chair is being used by a person, the seat backrest can be inclined counter to the spring force into a rear end position when the person is supported on the seat backrest. Furthermore, it is known to move the seat element together with the seat backrest by way of the seat inclination mechanism. Depending on the configuration of the seat inclination mechanism, the seat element can be tilted together with the seat backrest or else be displaced in the longitudinal direction of a seat surface. The seat inclination mechanism, together with the spring, can be formed in the manner of a lever transmission. The seat element and also the seat backrest can be formed from a shell, which is formed of metal or plastic, or from a frame having a padding and a cover or a covering composed of a textile fabric.

A disadvantage with the known chairs having a seat inclination mechanism is that, by virtue of the formation of the seat inclination mechanism and the connection thereof to the base column, the seat element and the seat backrest, they are formed from many parts. In particular, the lever transmission of the seat inclination mechanism frequently consists of a number of levers and springs which, by virtue of the stability to be ensured, are formed from metal. The production of such a chair or such a seat inclination mechanism therefore requires a large number of parts involving a high degree of assembly effort.

SUMMARY OF THE INVENTION

The object on which the invention is based is to provide a chair and a seat inclination mechanism of the generic type stated at the outset which are designed in an optimized manner with regard to the aforementioned problem.

This object is achieved according to the invention by the subject matter of the independent patent claims. Advantageous embodiments of the invention are specified in the dependent claims.

The invention proposes that a transverse strut of a seat inclination mechanism of a chair, in particular an office chair, forms a spring device, wherein this spring device has at least one torsion element. In particular, it is proposed to form a transverse strut as an integral, deformable torsion element, that is to say a torsion element which is integrated in one piece into a component of the chair. The torsion element allows not only deformability of the chair component, for example of a basic support, of a seat support or of a backrest support, wherein this deformability results advantageously in a functionality of the chair component that is based solely on this deformability. As energy store, the torsion element additionally also provides a counterforce which is directed counter to a functional deformation, for example a deflection.

The invention proposes providing storage members as integral, deformable structural parts (torsion elements) of the chair mechanism (seat inclination mechanism). In other words, instead of spring elements which have to be produced separately and mounted in the mechanism assembly, it is intended to make use of at least one of the chair components in any case present for providing the functionality of the seat inclination mechanism, in particular basic support, seat support and/or backrest support, as storage member. It is additionally possible in this way for actual rotary points, in particular those which have been realized hitherto by rotary joints, to be replaced by virtual rotary points. In this way, the number of structural parts required for the seat inclination mechanism and hence the production and assembly costs for chair mechanisms can be reduced. Reducing the number of actual rotary points minimizes the material stressing and the wear in axles guided in bearings and hence the failure risk and also increases the service life of the chair mechanism. Further advantages result from novel construction and design approaches which become possible with the integrated design. Thus, it is possible for example to provide seat inclination mechanisms which require considerably less installation space. In particular, mechanisms of considerably flatter construction can result.

Preferably, the torsion elements are deformable by virtue of the chair component being acted on in a targeted manner to achieve a movement; in other words, they deform on account of their integral design when the chair component has a force or a torque applied to it in a targeted manner. The torsion element according to the invention is thus distinguished by the fact that its deformation is directed toward an intended and thus desired movement of the chair component into which it is integrated.

The torsion elements preferably consist of a plastics material. Since plastics materials have for a long time been used in the production of seating furniture components, in particular of office chair components, suitable devices and systems for production and assembly are already present. There is therefore no need for any conversion to occur in this regard. In addition to using plastics materials, it is in principle also possible for other materials to be used that allow provision of an elastically deformable energy store, such as for example the use of wooden materials.

In a particularly preferred embodiment of the invention, the torsion element according to the invention is used to make a desired movement of a chair component possible in the first place. Expressed in other terms, this movement of the chair component would not be possible at all without this element. A seat inclination mechanism according to the invention configured in this sense comprises a number of interacting structural parts whose interaction serves for carrying out a movement occurring a certain manner, that is to say to allow an intended movability and thus functionality of the seat inclination mechanism, and is characterized in that at least one of these structural parts, by virtue of its configuration with the torsion element according to the invention, is at least partially elastically deformable under loading, in particular under the action of a force or of a torque, in such a way that the intended movability of the device is achieved. Here, it is preferably solely the deformability of this at least one torsion element that makes possible the intended movability of the mechanism or of the chair. Unless otherwise specified, the term "deformable" is always used in the sense of "elastically deformable". In other words, the deformation element changes its shape under the action of force and, in the absence of the acting force, returns to the original shape.

Multi-jointed coupling transmissions, as are known from the prior art, can be regarded as a kinematic chain. By virtue of the joints of such a coupling transmission, said coupling transmissions have degrees of freedom of movement. According to a preferred embodiment of the invention, a multi-jointed coupling transmission for a seat inclination mechanism of a chair, in particular an office chair, can be provided which theoretically, when using ideally stiff materials, no longer has such a degree of freedom. A movement of the coupling transmission is then allowed according to the invention only by the use of the torsion element which, in the application of the invention to a seat inclination mechanism, is formed as an integral constituent part of the coupling transmission, in particular as one of the couplers of the coupling transmission or as a part of one of the couplers of the coupling transmission. The kinematic chain formed thereby comprises not only a number of actual rotary points (that is to say one or more actual rotary points) but also at least one virtual rotary point, but preferably a plurality of virtual rotary points. Here, the torsion element can be formed in such a way that it consists of a concatenation of virtual rotary points. In other words, it is proposed that rotary points and/or coupling elements be completely or partially replaced by a number of, that is to say one or more, component-integrated torsion elements.

It is therefore possible in a simple and cost-effective manner by means of the invention for structural parts, components and assemblies of seating furniture, in particular of chairs, and also seat inclination mechanisms of any type, to be provided which have a plurality of rotary points positioned in an exactly defined manner. Here, the position of these rotary points can be either stationary, that is to say unchangeable, or changeable. In particular, the position of the rotary points can also change during the movement of the seating furniture or the movement of a structural part, a component or an assembly of the seating furniture. It is possible in this way, with few structural parts, for mechanical devices having highly complex movement characteristics to be produced. The type of deformation of the torsion element can be defined by a targeted configuration of said element and be used in a targeted manner to provide a desired movement of a loaded structural part, in particular of a component of the seat inclination mechanism or of the chair.

Seat inclination mechanisms can be produced with a small number of structural parts in a particularly simple manner by means of the torsion element according to the invention. The term seat inclination mechanism used here also includes those chair mechanisms which, in addition or alternatively to an inclination movement in the chair longitudinal direction, that is to say rearward or forward, also allow a lateral inclination movement of one or more chair components, that is to say a movement to the right or left.

According to the invention, the torsion element serves at the same time as an energy storage member which is integrated in the mechanism component providing the torsion element. The torsion element can thus define not only a restoring force for a pivoted mechanism component but also serves for determining a pivoting resistance of a mechanism component. The storage member experiences a reversible deformation under the influence of load. The elasticity of the storage member, upon loading, produces a restoring torque by means of which said member automatically returns back into its nondeformed initial shape as soon as the forces or torques acting on it are discontinued.

In particularly preferred embodiments of the invention, the stiffness of the torsion element is dependent on the direction of action of the force acting on the torsion element. Expressed in other terms, the deformation element is formed in such a way that it deforms differently in dependence on the direction of action of the force acting on it. This is preferably achieved by means of a suitable structural design of the torsion element.

The integration according to the invention of the energy store into a present component of the seat inclination mechanism makes it possible for the number of structural parts (individual parts, assemblies) to be reduced by comparison with the seat inclination mechanisms known from the prior art. This reduces the outlay required for the storage of parts and the assembly effort.

During the production of that mechanism component which has the torsion element, either only a single plastics material is used during the injection-molding method or two or more different plastics are used (multicomponent injection-molding). There is no need to change the material composition during the injection-molding if the desired deformation properties of the deformation element can be achieved exclusively by means of a structural configuration.

On the one hand, the material suitable for producing the torsion element has the necessary stiffness in order to ensure the required stability and strength of the structural part. On the other hand, the material is elastic enough to provide the desired deformability during the desired movement.

In the installed state, the deformation behavior of the torsion element can be changed with the aid of suitable adjusting mechanisms. These can be for example mechanically acting mechanisms which completely or partially limit or block the deformability of a part of the torsion element or the deformability of the entire torsion element. However, to change the deformation behavior, it is also possible for example for the stiffness of the torsion element to be changed in a targeted manner by temporarily changing a material property of the torsion element.

With the use of torsion elements made of plastic, as is proposed by the invention, the counterforce to be overcome by the user of the chair during the movement of the seat inclination mechanism is generated by the plastics material.

Since component-integrated torsion elements made of plastics material are used instead of spring elements or energy stores made of steel, the weight of the seat inclination mechanism and hence the weight of the chair can be reduced by comparison with conventional constructions. This is particularly advantageous in the case of chairs when they are intended to be setup in a positionally variable manner, as is the case with office chairs. At the same time, the recycling of such assemblies is simplified since no separation of materials has to take place.

The torsion element according to the invention can be used in a wide variety of ways. Even though the principle underlying the invention will be explained below using the example of seat inclination mechanisms for office chairs, the invention is neither limited to the fact that the application occurs in a seat inclination mechanism having the described movement characteristic nor to the fact that the torsion element is a part of a specific chair component, for example of the basic support. The concept of the invention can also be realized with the aid of deformable parts of other construction elements or assemblies of chair mechanisms. In addition, the concept of the invention can be realized with different types of chair mechanisms, in particular with synchronous mechanisms in which the pivoting movement of the backrest occurs with a certain relative movement of seat and backrest with respect to one another, and with rocker mechanisms in which the pivoting movement of the backrest occurs together with the seat as a movement unit. However, for the purposes of the invention, a seat inclination mechanism is to be understood as meaning any conceivable chair mechanism, including asynchronous mechanisms, in which the pivoting movement of the backrest occurs independently of the seat or in the case of an immovable seat.

The torsion element according to the invention can be used in particular as part of a basic support, as part of a seat support or as a part of a backrest support. However, the torsion element can also form the entire basic support, seat support or backrest support. In these cases, a minimum number of rigid or substantially rigid regions are preferably provided on the torsion element, said regions forming nondeformable connection regions which are required for the interaction of these assemblies with other assemblies or components.

In particular, the torsion element according to the invention can form a part of a one-piece basic support-seat support combination, a part of a one-piece basic support-backrest support combination, a part of a one-piece seat support-backrest support combination or a part of a one-piece seat support-basic support-backrest support combination.

However, the torsion element can also form an entire one-piece basic support-seat support combination, an entire one-piece basic support-backrest support combination, an entire one-piece seat support-backrest support combination or an entire one-piece seat support-basic support-backrest support combination. In these cases, a minimum number of rigid or substantially rigid regions are preferably provided on the torsion element, said regions forming nondeformable connection regions which are required for the interaction of the respective combination with other components or structural parts.

If the invention is applied in a chair mechanism, this mechanism does not necessarily have to be a mechanism in which the degree of freedom necessary for carrying out the movement is provided only with the use of the torsion element. The torsion element according to the invention can also be used in traditionally constructed chair mechanisms in which steel springs or other separate spring elements are used. Expressed in other terms, it is possible to combine the use of a torsion element according to the invention with conventional spring arrangements. In hybrid mechanisms of such type, the combination of separate and integrated energy stores results in multiple design possibilities which can be used both for providing ergonomically advantageous movement sequences and for realizing chair mechanisms of particularly small or flat construction and for creating particularly elegant mechanisms.

According to a first and second embodiment of the invention, a chair, in particular an office chair, is proposed which comprises a base frame having a base column on which a seat element and a seat backrest are mounted via a seat inclination mechanism, wherein the seat inclination mechanism comprises a basic support which is connected to the base column and on which a backrest support and a seat element support are articulated, and the seat element and the seat backrest are connected to one another via a joint connection of the seat inclination mechanism, wherein a transverse strut of the seat inclination mechanism forms a spring device, wherein the transverse strut extends in the chair transverse direction and wherein the spring device has at least one torsion bar spring.

According to the first embodiment, the transverse strut is attached to the basic support, wherein the backrest support, together with the basic support and the torsion bar spring, is formed integrally, in particular in one piece, from plastic. According to the second embodiment, the basic support or the seat element support, together with the torsion bar spring, is formed integrally, in particular in one piece, from plastic. According to a third embodiment of the invention, the torsion bar springs, together with the basic support and the seat element support and/or together with the backrest support, are formed integrally, in particular in one piece.

By virtue of the fact that the transverse strut of the seat inclination mechanism forms a spring device, a structural part of the seat inclination mechanism can be used to generate a spring force for restoring the seat backrest. The transverse strut which is attached to the basic support and/or to the seat element support and/or to the backrest support and which forms the spring device makes it possible to substantially reduce a parts number of the seat inclination mechanism. Producing a chair having a customary range of functions thus becomes possible in a comparatively more simple and more cost-effective manner.

The spring device has at least one torsion bar spring or is at least one torsion bar spring. The torsion bar spring can then be formed in a particularly simple manner as a bar-shaped spring or torsion bar. In particular, the transverse strut itself can form the torsion bar spring. The integral, in particular one-piece, design of the torsion bar spring with further chair components made of plastic can be achieved particularly cost-effectively in large numbers for example by means of injection-molding or compression molding. There is then no longer a need for special assembly of the basic support or the seat element support with the torsion bar springs.

There can be provision here that the spring device is designed with preloading. For example, the seat inclination mechanism can be assembled with the transverse strut in such a way that the transverse strut exerts a spring force on the seat backrest, said spring force always restoring the seat backrest into a front end position in the unloaded state.

Preferably, two torsion bar springs of the spring device can be integrally attached to the basic support and, with respect to a vertical chair longitudinal center plane, be attached at their respective distal ends to a lever of the seat inclination mechanism. The transverse strut attached to the basic support can then form two torsion bar springs which are each integrally formed on the basic support. Respective proximal ends of the torsion bar springs can accordingly be integrally formed on the basic support and a spring force produced by the torsion bar springs can be transmitted via in each case a lever at distal ends of the torsion bar springs. The lever can extend substantially orthogonally relative to a longitudinal axis of the torsion bar spring or of the transverse strut.

According to the first embodiment, the backrest support, together with the basic support and the torsion bar springs, can be formed integrally, in particular in one piece, from plastic and form the levers of the seat inclination mechanism. For example, the backrest support can be designed in the manner of a frame at whose lower end the basic support is integrally formed for connection to the base column. The transverse strut is then formed by a lower, perpendicular bar of the frame. The parallel-extending bars or legs of the frame that are attached to the transverse strut then in each case form the lever of the seat inclination mechanism. A further frame for receiving a backrest pad or a covering can be arranged or integrated on the frame. An inclination of the frame as a result of a weight force of a person then brings about torsion of the transverse strut since the latter is fixedly connected on the basic support to the base column.

The seat element support can be formed from struts, which are articulated on the basic support, and rear rotary joints which are arranged on the levers and which can hold the seat element. The struts can also be integrally formed with the basic support made of plastic and extend in the direction of a front edge of the seat element. The seat element can thus be mounted in a simple manner on the struts on the front side and on the rear rotary joints at the rear side. The rotary joints can for example be formed by means of a cutout in a frame of the backrest support, into which cutout axles integrally formed on the seat element are in each case inserted. Alternatively, the axles can be integrally formed on the frame and be inserted into cutouts in the seat element.

Furthermore, at least one front rotary joint, which is displaceable in an oblong hole, can be formed between the struts and the seat element, wherein a pivoting movement of the backrest support on the rotary springs can cause a displacement of the seat element in the chair longitudinal direction relative to the basic support. The oblong hole or the front rotary joint can be formed at distal ends of the struts, wherein a correspondingly formed rotary joint or an axle or an oblong hole can be formed on the seat element. The rotary joint or the axle can then be displaced and pivoted in the oblong hole, with the result that it is possible, during a pivoting movement of the seat backrest, to displace the seat element in the chair longitudinal direction with the seat backrest.

The spring device can have a setting device for setting a spring constant of the torsion bar springs, wherein the setting device can be formed from support elements which are displaceable in the longitudinal direction of the oblong hole. The support elements can increase a profile cross section of the respective torsion bar spring, and hence increase a resistance torque in certain portions. For example, the support elements can be inserted into the oblong hole and be displaced along the oblong hole, with the result that, during a displacement of the support elements in the direction of the base column, a comparatively lower spring stiffness can be achieved and, during a displacement of the support elements in the direction of a distal end of the torsion bar springs, a comparatively larger spring stiffness can be achieved.

The support elements can be formed in each case as a threaded pin having an inner profile whose oppositely arranged threads can engage in transverse oblong holes formed in the oblong hole, wherein the support elements can, by means of a rotation of an actuating shaft of the setting device that is inserted in the inner profile, be designed to be displaceable in the longitudinal direction of the oblong hole. The threaded pins can then be pushed onto the actuating shaft, wherein a rotation, configured for example by means of a hand-actuatable crank, of the actuating shaft causes, by virtue of the opposite threads, a movement of the threaded pins relative to one another or away from one another, in dependence on the direction of rotation. The inner profile is preferably designed to correspond with a cross section of the actuating shaft. The transverse oblong holes which can run orthogonally to the oblong hole can be formed in a simple manner by machining or shaping. The displacement of the threaded pins as a result of a rotation of the actuating shaft also brings about setting of the spring constant.

According to the invention, according to the first embodiment a seat inclination mechanism for a chair, in particular an office chair, is proposed which comprises a basic support which can be connected to a base column of the chair, wherein two torsion bar springs of the seat inclination mechanism are integrally attached to the basic support and, with respect to a vertical chair longitudinal center plane, are attached at their respective distal ends to a lever of the seat inclination mechanism, wherein a backrest support of the chair, together with the basic support and the torsion bar springs, is formed integrally, in particular in one piece, from plastic and forms the levers of the seat inclination mechanism, wherein a seat element support of the chair is formed from struts, which are articulated on the basic support, and rear rotary joints which are arranged on the levers and which hold the seat element, wherein at least one front rotary joint which is displaceable in an oblong hole is formed between the struts and the seat element, wherein a pivoting movement of the seatback support on the torsion bar springs causes a displacement of the seat element in the chair longitudinal direction relative to the basic support.

Moreover, according to the invention a setting device for a chair, in particular an office chair, is proposed, wherein the setting device serves for setting a spring constant of torsion bar springs of a seat inclination mechanism of the chair, wherein the torsion bar springs are formed from a bar-shaped profile portion having an oblong hole running at least in certain portions in a longitudinal direction of the profile portion, wherein the setting device is formed from support elements which are displaceable in the longitudinal direction in the oblong hole, wherein the support elements are formed in each case as a threaded pin having an inner profile whose oppositely arranged threads engage in transverse oblong holes formed in the oblong hole, wherein the support elements are displaceable by means of a rotation of an actuating shaft, which is inserted in the inner profile, of the setting device in the longitudinal direction of the oblong hole. For the advantages of the setting device, reference is made to the description of the advantages of the chair according to the invention. Further advantageous embodiments of a setting device result from the descriptions of the features of the claims.

According to the second advantageous embodiment, the basic support, together with the torsion bar springs, can be formed integrally, in particular in one piece, from plastic and form the levers of the seat inclination mechanism. The basic support can extend for example in the direction of a front edge of the seat element, wherein the torsion bar springs can be integrally formed on a front end of the basic support. At the same time, the levers of the seat inclination mechanism can be integrally formed on the transverse strut or the torsion bar springs substantially orthogonally relative to a longitudinal axis thereof. It is thus also possible to connect the levers directly to the support element and, via the seat element, to transmit a restoring force of the rotary joints to the movement of the seat backrest.

The backrest support can be connected to the basic support via a lower rotary joint. For example, the backrest support can be formed in the manner of a frame which can be provided with a backrest pad or a textile covering. The frame can be directly pivotably fastened to the basic support or pivotably fastened to the basic support via a connection portion which is integrally formed on the frame.

This pivotable fastening can be formed in a simple manner via the lower rotary joint and thus allow a pivoting movement of the backrest support or of the seat backrest.

Furthermore, the seat element support can be formed from at least one strut, which is articulated on the backrest support, and the levers which hold the seat element. The strut, together with the backrest support, can also be formed integrally, in particular in one piece, and serve for connection to the seat element. The strut can be connected to the seat element in a rear region thereof and support said seat element. It is also optionally possible for a plurality of struts to be integrally formed on the backrest support, which are then connected to the seat element. The levers can also be directly connected to the seat element, with the result that the seat element is directly supported on the levers in a front region of the seat element.

A rear rotary joint can be formed between the strut and the seat element, and the levers can be connected to the seat element via in each case a front rotary joint, wherein a pivoting movement of the backrest support on the lower rotary joint can cause a displacement of the seat element in the chair longitudinal direction relative to the basic support. A pivoting movement of the backrest support on the lower rotary joint can accordingly cause the displacement of the seat element in the chair longitudinal direction, through the attachment of the seat element to the rear rotary joint or the strut. The levers which are connected to the seat element via the front rotary joint are then moved by the displacement of the seat element in the chair longitudinal direction, thereby producing a torsion of the torsion bar springs and thus the generation of a spring force or restoring force.

With respect to a vertical chair longitudinal center plane, two torsion bar springs of the spring device can be attached at their respective distal ends to the seat element and be attached, via a lever formed integrally with the torsion bar springs, to a front rotary joint of the seat inclination mechanism on the basic support.

The distal ends of the torsion bar springs can be screwed to or integrally formed on the seat element.

A rear rotary joint can be formed between the seat element support and the seat element, and the lever can be connected to the basic support via the front rotary joint, wherein a pivoting movement of the backrest support on the lower rotary joint can cause a displacement of the seat element in the chair longitudinal direction relative to the basic support.

The seat element support can be formed from a frame which forms the transverse strut, wherein, with respect to a vertical chair longitudinal center plane, two torsion bar springs of the spring device can be attached at their respective distal ends to the frame and can be attached, via a lever formed integrally with the torsion bar springs, to a front rotary joint of the seat inclination mechanism on the basic support.

A rear rotary joint can be formed at a rear end of the frame, and the backrest support can be connected to the seat element support via the rear rotary joint, wherein a pivoting movement of the backrest support on the lower rotary joint can cause a displacement of the seat element in the chair longitudinal direction relative to the basic support.

According to the invention, according to the second embodiment a seat inclination mechanism for a chair, in particular an office chair, is proposed which comprises a basic support, which can be connected to a base column of the chair, an extension, which is articulated on the basic support, of a backrest support of the chair, and a seat element support, wherein two torsion bar springs are integrally attached to the basic support or the seat element support and, with respect to a vertical chair longitudinal center plane, are attached at their respective distal ends to a lever of the seat inclination mechanism or to the seat element support, wherein the extension is connected to the basic support via a lower rotary joint, wherein the seat element support is formed from at least the extension and the lever which holds the seat element, wherein a rear rotary joint is formed between the extension and the seat element, and the lever is connected to the seat element or the seat element support via in each case a front rotary joint, wherein a pivoting movement of the backrest support with the extension on the lower rotary joint causes a displacement of the seat element in the chair longitudinal direction relative to the basic support.

According to further embodiments of the invention, the torsion elements, in particular in the form of torsion bar springs, together with the basic support and the seat element support and/or together with the backrest support and the seat element support and/or together with the basic support and the backrest support, can be formed integrally, in particular in one piece. In other words, the torsion elements are integrally attached to the basic support and/or integrally attached to the seat element support and/or integrally attached to the backrest support.

The seat inclination mechanism advantageously has a plurality of transverse struts which are formed integrally, in particular in one piece, with the result that the number of the actual rotary joints and required structural parts can be reduced further still.

According to the invention, the invention provides a seat inclination mechanism for a chair, in particular an office chair, said mechanism comprising a basic support on which a backrest support and a seat element support are articulated, wherein a transverse strut of the seat inclination mechanism forms a spring device, wherein the transverse strut extends in the chair transverse direction and wherein the spring device has at least one torsion element, in particular a torsion bar spring, and wherein the torsion element, together with the basic support or the backrest support or the seat element support, is formed integrally, in particular in one piece, from plastic. This does not exclude the seat inclination mechanism comprising a plurality of transverse struts with spring devices, wherein the torsion elements of these spring devices, depending on the arrangement of the transverse struts on various components of the chair mechanism, can also be formed integrally, in particular in one piece, with the basic support and/or with the seat element support and/or with the backrest support.

Common to all the embodiments is the fact that the torsion bar spring or torsion bar springs can be formed from a bar-shaped profile portion having an oblong hole which runs at least in certain portions in a longitudinal direction of the profile portion. The oblong hole can in principle also be formed in the manner of a continuous oblong hole on the transverse strut. It is essential here that a cross section of the profile portion is such that a resistance torque suitable for generating a spring force is formed. The torsion bar spring can then, on the one hand, be readily elastically deformed and, on the other hand, produced cost-effectively from plastic, for example. A desired spring constant of the torsion bar spring can then be formed by a corresponding formation of the oblong hole.

The spring device can have a further torsion bar spring made of spring steel, wherein the further torsion bar spring can be inserted into the oblong hole and can in each case be fastened in a rotationally fixed manner at its proximal end to the basic support or the seat element support or the backrest support and at the distal end to the lever of the seat inclination mechanism. The further torsion bar spring made of spring steel makes it possible for a spring constant of the torsion bar spring to be adapted in a simple manner. For example, it is then also possible to adapt a chair to different weight classes of users. The further torsion bar spring can be formed from wire formed from the spring steel, wherein the proximal end and the distal end can be bent at a right angle. In the region of the oblong hole there can in each case be formed two bores for receiving the proximal or distal end. The further torsion bar spring can then be fixed at the proximal end and the distal end in a simple manner by being plugged into the bores. The further torsion bar spring can also be fixed by the proximal end and the distal end to the bores in such a way that a preloading of the further torsion bar spring is formed.

For the advantages of the seat inclination mechanism according to the embodiments, reference is made to the description of the advantages of the chair according to the invention. Further advantageous embodiments of a seat inclination mechanism result from the descriptions of the features of the patent claims.

Further advantages and advantageous refinements of the subject matter according to the invention can be found in the description, the drawing and the claims.

Exemplary embodiments of a chair according to the invention are illustrated in schematically simplified form in the drawing and are explained in more detail in the following description.

DETAILED DESCRIPTION OF THE INVENTION

Figure 1:
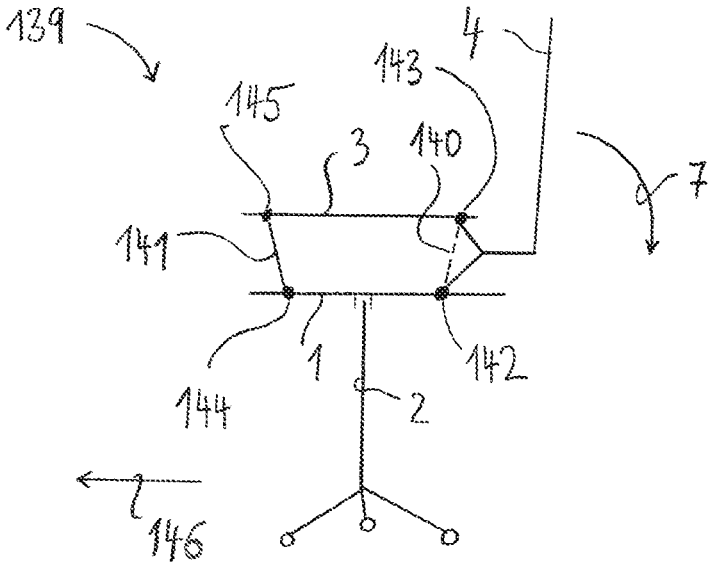
FIG. 1 PRIOR ART
FIG. 1 shows a seat inclination mechanism (prior art)

FIG. 1 shows the prior art. FIGS. 2 to 12 show a first embodiment and variants thereof, and FIGS. 13 to 26 show a second embodiment and variants thereof.

All the figures show the invention not true to scale, here merely schematically and only with its essential constituent parts. The same reference signs correspond here to elements having an identical or comparable function.

"At the front" or "front" here means that a structural part is arranged at the front in the chair longitudinal direction or refers to a component extending in the direction of the front seat edge or pointing in this direction, whereas "at the rear" or "rear" means that a structural part is arranged at the rear in the chair longitudinal direction or refers to a component which extends in the direction of the backrest or of the backrest support or of the rear seat edge or points in this direction. The expressions "at the top" or "upper" or "higher" and "at the bottom" or "lower" or "deeper" relate to the intended use state of the office chair or of the office chair mechanism.

In order to illustrate the pivoting principle, FIG. 1 depicts in highly simplified form a seat inclination mechanism generally known from the prior art. This is a synchronous mechanism 139 in which the three main components of the mechanism, namely basic support 1, seat element support 3 and backrest support 4, are coupled to one another via rotary joints, with the result that a pivoting movement of the backrest support 4 in the pivoting direction 7, as seen in the chair longitudinal direction 146, induces toward the rear a synchronous following movement of the seat element support 3, whereas the basic support 1 remains positionally fixed and immovable. The mechanism is mounted by its basic support 1 on a base column 2 which stands on the floor by way of a chair cross. The backrest support 4, forms with its articulation to the basic support 1 on the one hand and to the rear region of the seat element support 3 or of the seat shell or of the seat frame on the other hand, a rear coupling element 140 integrated into the backrest support 4, whereas a separate front coupling element 141 connects the basic support 1 to the front region of the seat element support 3 or of the seat shell or of the seat frame. In this way there are provided four rotary points, realized by four rotary joints, wherein each rotary joint is assigned a transverse axle. These are the first rotary joint 142 for connecting the basic support 1 to the rear coupling element 140, the second rotary joint 143 for connecting the rear coupling element 140 to the seat element support 3, the third rotary joint 144 for connecting the basic support 1 to the front coupling element 141, and the fourth rotary joint 145 for connecting the front coupling element 141 to the seat element support 3.

According to the invention, it is then possible in principle for all the actual rotary points realized by rotary joints 142, 143, 144, 145 to be replaced by virtual rotary points which are provided by one or more torsion elements according to the invention.

The transverse axis according to the invention, which has the spring device, of the seat inclination mechanism can serve for forming any desired rotary joints of the seat inclination mechanism. Thus, for example, a front, upper transverse axle serving to form the rotary joint 145 can have the spring device according to the invention. Alternatively or additionally, a front, lower transverse axle serving to form the rotary joint 144 can have the spring device according to the invention. Alternatively or additionally, a rear, upper transverse axle serving to form the rotary joint 143 can have the spring device according to the invention. Alternatively or additionally, a rear, lower transverse axle serving to form the rotary joint 142 can have the spring device according to the invention.

The invention is not restricted to the use of a single transverse axle according to the invention in a seat inclination mechanism. Thus, a seat inclination mechanism can have a plurality of such transverse axles with spring devices. It is for possible for example for transverse axles according to the invention all to form front rotary joints, as seen in the chair longitudinal direction, of a seat inclination mechanism and/or transverse axles according to the invention can all form rear rotary joints, as seen in the chair longitudinal direction, of a seat inclination mechanism. Likewise, it is possible for transverse axles according to the invention all to form lower rotary joints, which are assigned to the basic support, of a seat inclination mechanism and/or transverse axles according to the invention can all form upper rotary joints, which are assigned to the seat element support, of a seat inclination mechanism. A formation of the rotary joints by the transverse axles according to the invention in a "cross-over" arrangement is also possible (for example formation of the rotary joints bottom front and top rear). Possible in principle are any desired arrangements of the transverse axles according to the invention for forming an individual rotary joint, a plurality of selected rotary joints or all rotary joints of the seat inclination mechanism.

Each of the transverse axles according to the invention comprises a spring device having at least one torsion element, in particular a torsion bar spring. Transverse axles can be provided here which are formed essentially completely from a single torsion element. However, transverse axles can also be provided which have a plurality of torsion elements. Here, these torsion elements can be arranged behind one another along the longitudinal direction of the transverse axle. In this case, the torsion elements can also be spaced apart from one another. For example, the torsion elements of a transverse axle can be formed as axle portions which are connected to one another via axle portions with relatively low twistability or via rigid axle portions. Embodiments are also conceivable in which the transverse axle has a plurality of torsion elements arranged parallel to one another in the axle longitudinal direction.

The application of the transverse axles according to the invention is also not restricted to seat inclination mechanisms having four-joint coupling. The use in seat inclination mechanisms with another coupling geometry is also possible. Likewise possible is the application of one or more transverse axles according to the invention in seat inclination mechanisms in which use can also be made of deformation elements which run in the chair longitudinal direction and which deform, in particular bend, as a result of tensile or compressive loading.

A first embodiment of the invention will be described below. Here, the rotary joint 142 shown in FIG. 1 is replaced with the aid of a transverse strut according to the invention by a virtual rotary point.

Figure 2:
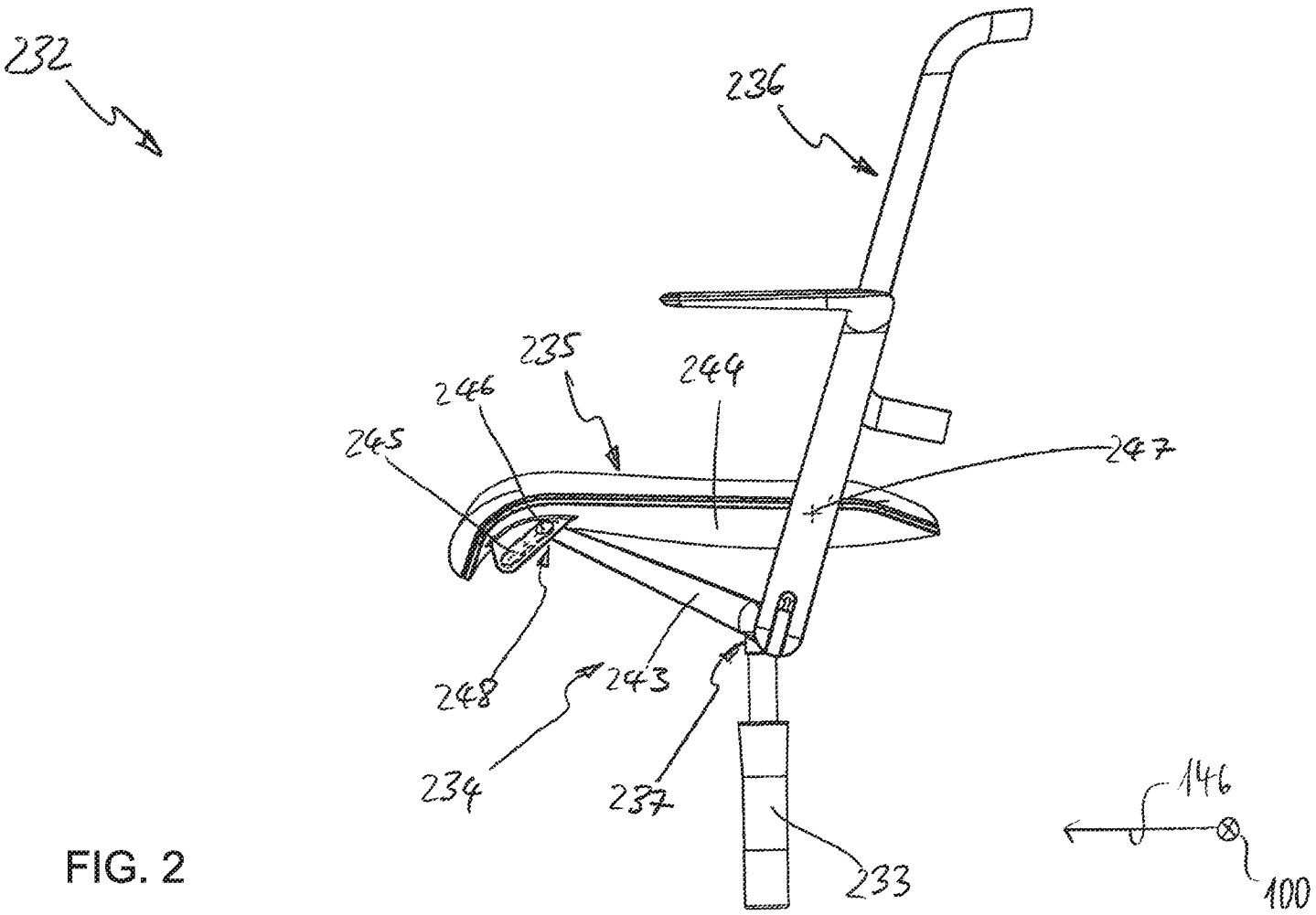
FIG. 2 shows a side view of a chair according to the invention (first embodiment)
Figure 3:
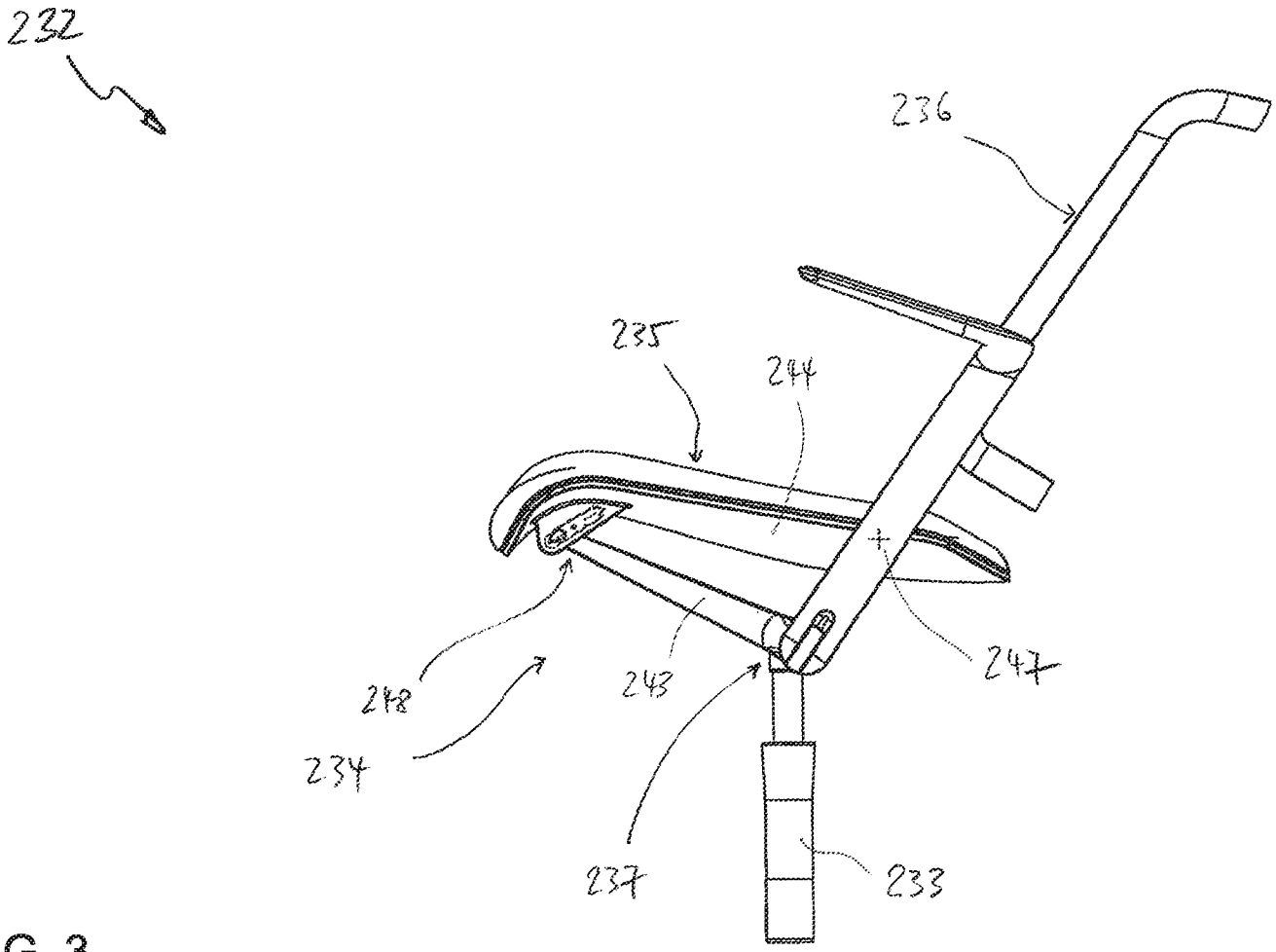
FIG. 3 shows a further side view of the chair from FIG. 2.
Figure 4:
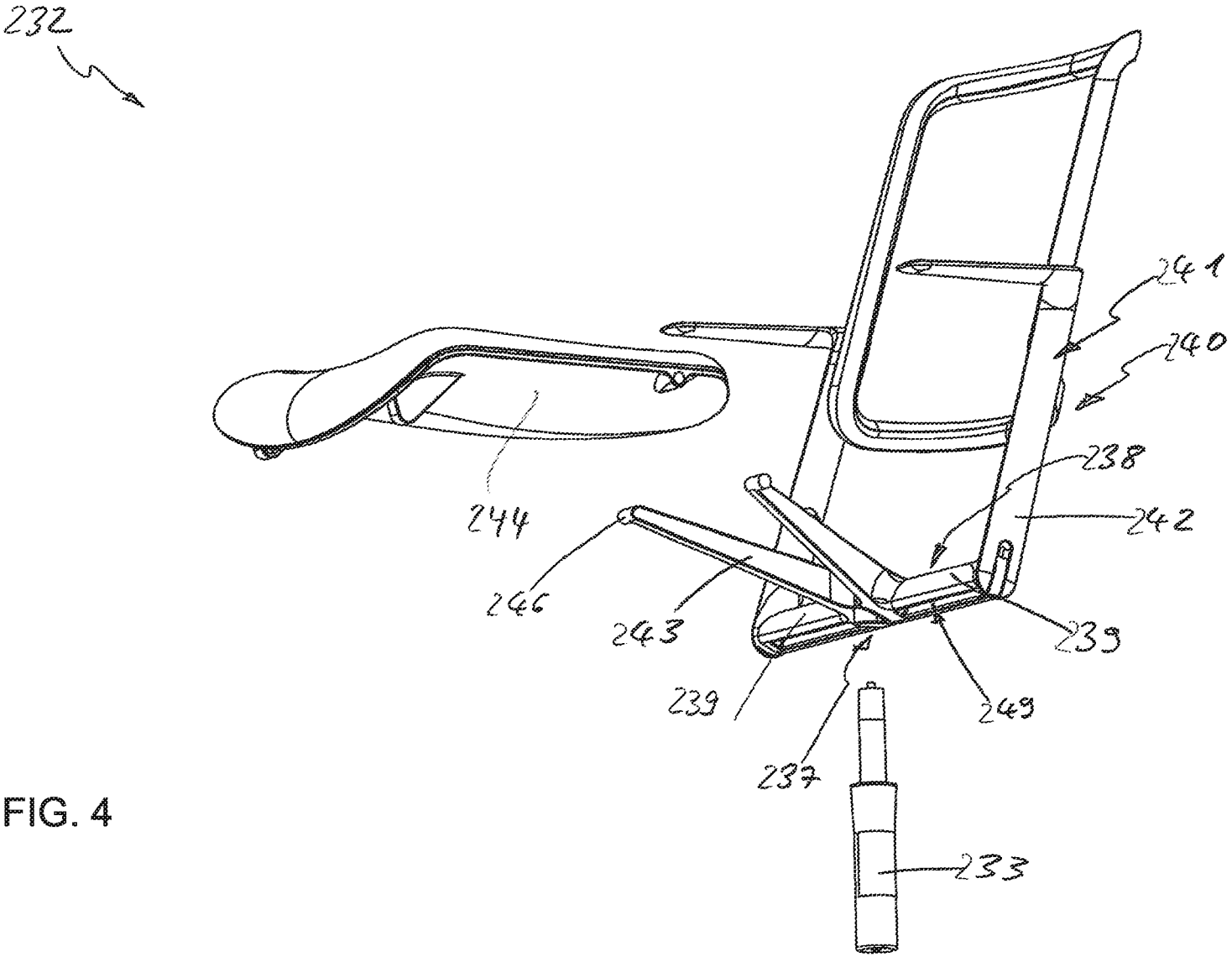
FIG. 4 shows a perspective exploded illustration of the chair from FIG. 2.
Figure 7:
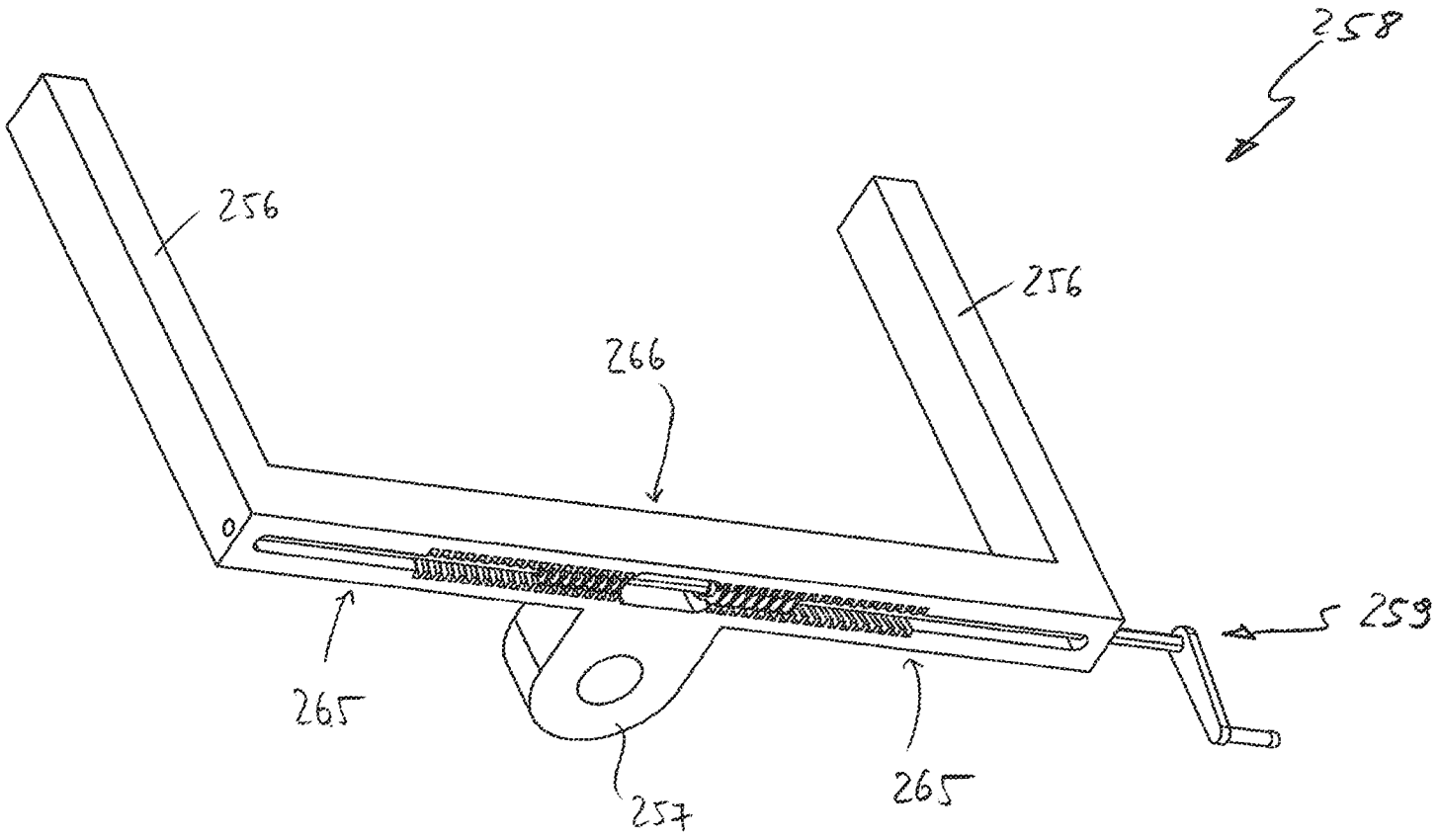
FIG. 7 shows a development of the basic support from FIG. 5 in a perspective view.

FIGS. 2 to 4 illustrate a chair 232 according to the invention which comprises a base column 233 with a roller cross (not shown in more detail), a seat inclination mechanism 234, a seat element 235, a seat backrest 236, and a basic support 237 connected to the base column 233. A transverse strut 238 of the seat inclination mechanism 234 forms torsion bar springs 239. In particular, an essentially frame-shaped backrest support 240 of the seat backrest 236, together with the basic support 237 and the torsion bar springs 239, is formed integrally, in particular in one piece, from plastic. Parallel legs 241 of the backrest support 240 form levers 242 of the seat inclination mechanism 234, said levers being integrally formed on the torsion bar springs 239. Furthermore, struts 243 which hold the seat element 235 are integrally formed on the basic support 237. In a seat shell 244 of the seat element 235 there are formed oblong holes 245 into each of which an axle 246 of the strut 243 is movably inserted. The oblong hole 245 and the axle 246 form a front rotary joint 248. Moreover, a rear rotary joint 247 is formed between in each case a leg 241 or lever 242 and the seat shell 244. An inclination of the seat backrest 236 toward the rear, as illustrated in FIG. 7, produces, in addition to the tilting of the seat backrest 236, a displacement of the seat element 235 toward the rear, wherein the axle 246 is also displaced in the oblong hole 245. The torsion bar springs 239 are in each case formed with an oblong hole 249 which runs in the longitudinal direction of the torsion bar spring 239. Overall, the chair 232 is essentially formed from the backrest support 240, which is integrally formed with the basic support 237 consisting of plastic, and the seat shell 244.

Figure 5:
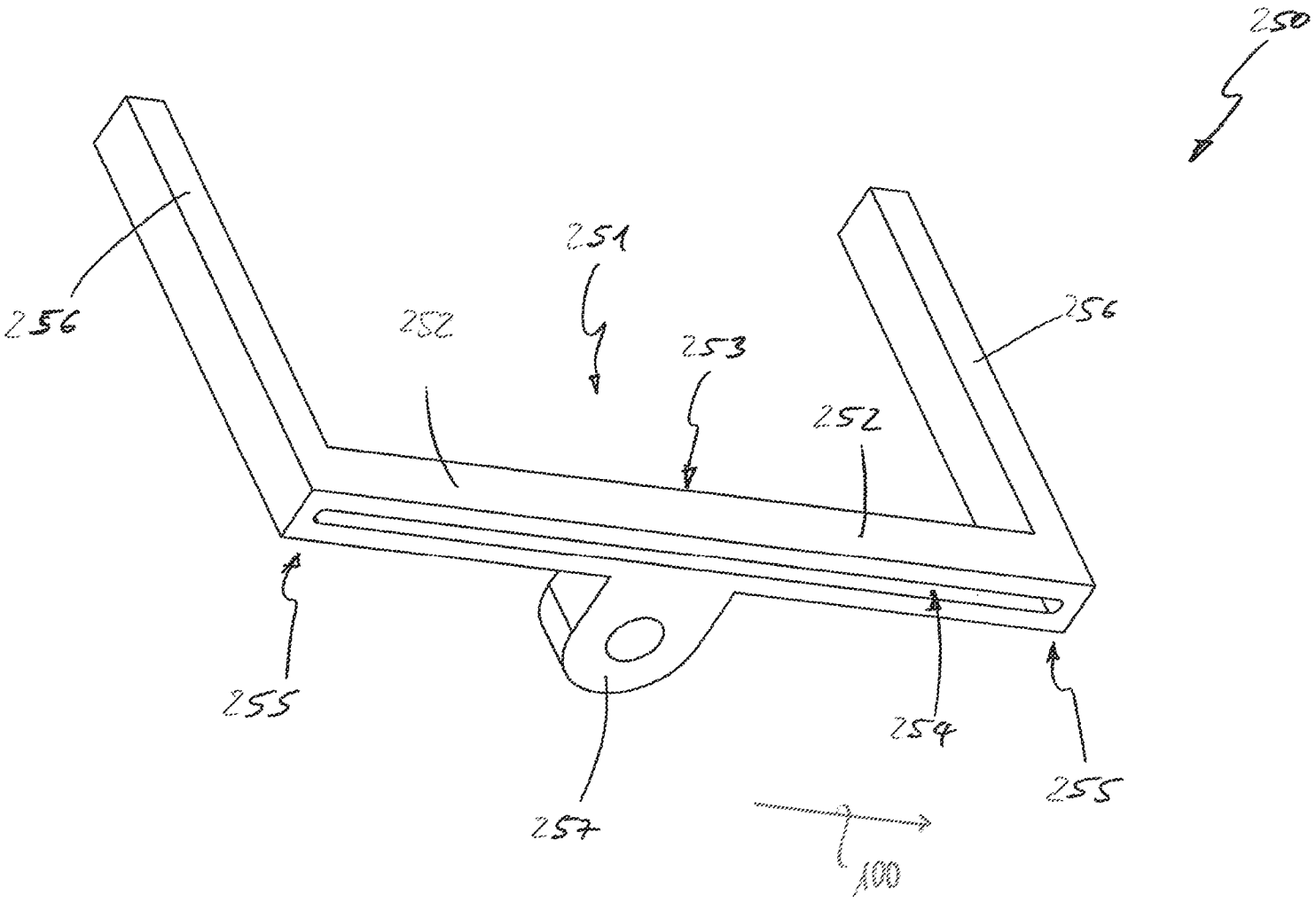
FIG. 5 shows an embodiment of a basic support in a perspective view.
Figure 6:
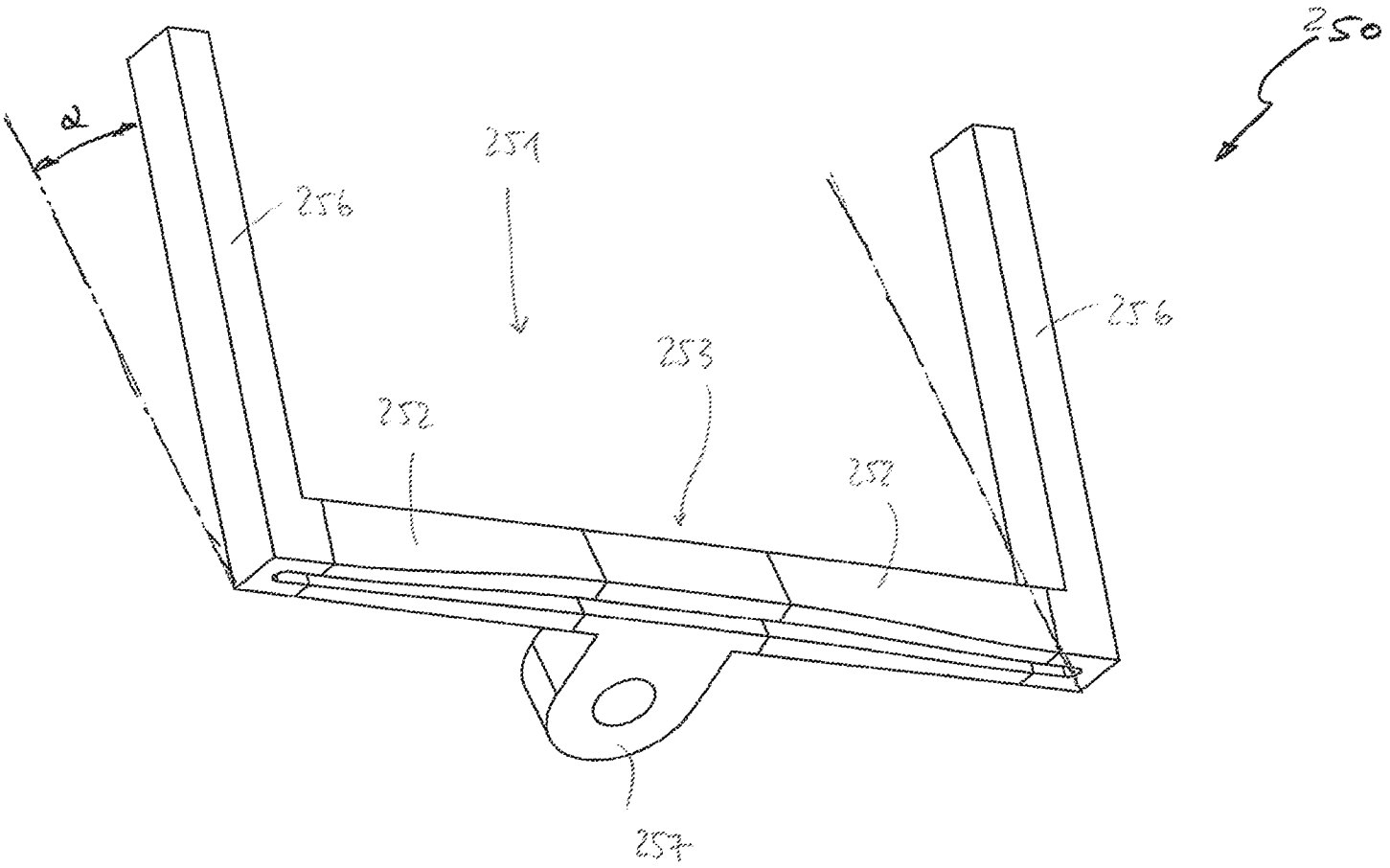
FIG. 6 shows a further perspective view of the basic support from FIG. 5.

FIGS. 5 and 6 show a schematic illustration of an embodiment of a basic support 250 which consists of plastic and which has a spring device 251 with torsion bar springs 252. The torsion bar springs 253 are formed by a transverse strut 253 having a continuous oblong hole 254, wherein in each case a pivotable lever 256 is integrally formed at distal ends 255 of the torsion bar springs 252. Furthermore, a flange 257 on the transverse strut 253 for connection to a base column (not shown in more detail here) of a chair is formed in the basic support 250. As can be seen from FIG. 6, the levers 226 can be inclined by an angle $\alpha$, thereby generating a spring force and a deformation of the torsion bar springs 252.

Figure 8:
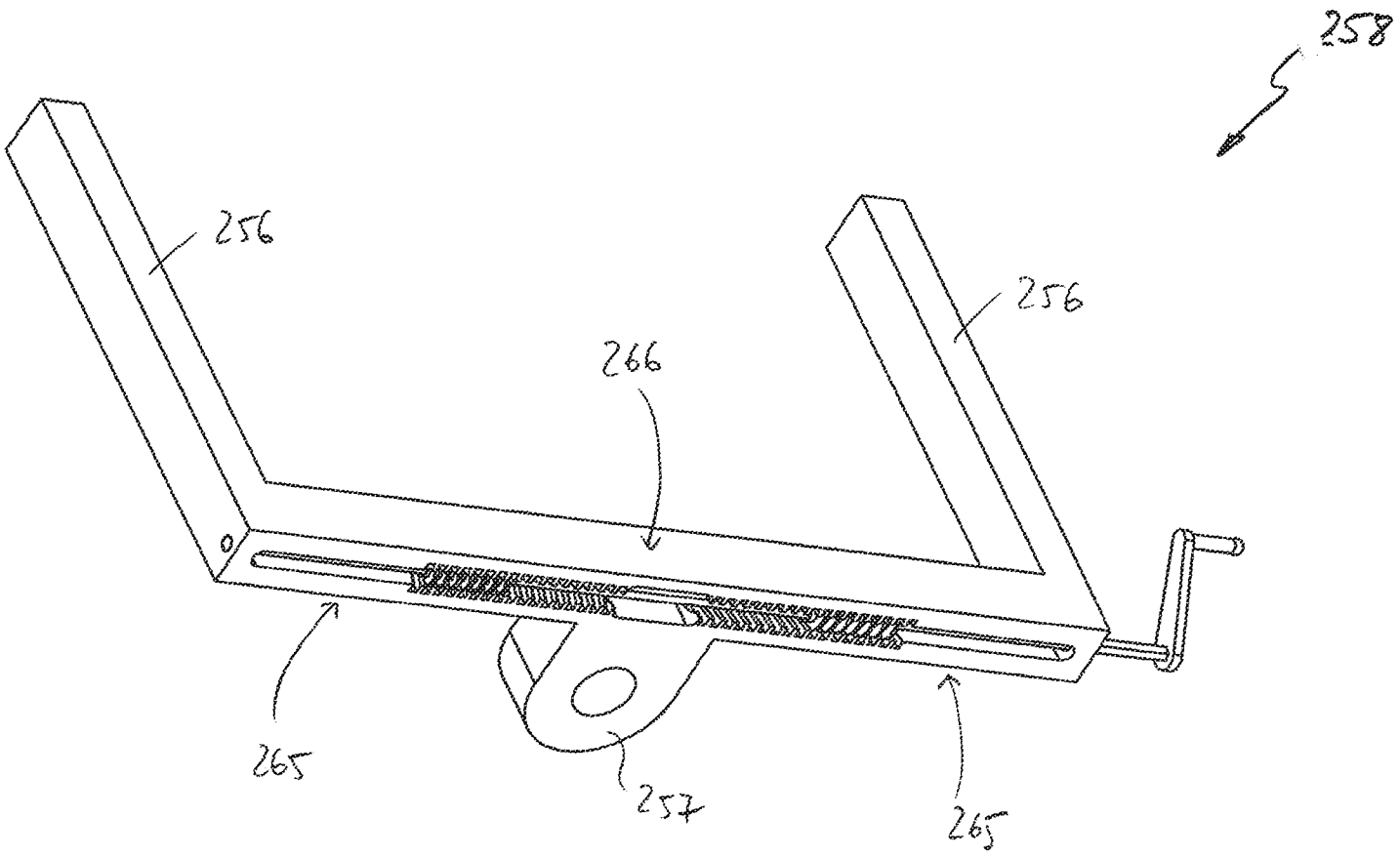
FIG. 8 shows a further perspective view of the basic support from FIG. 7.
Figure 9:
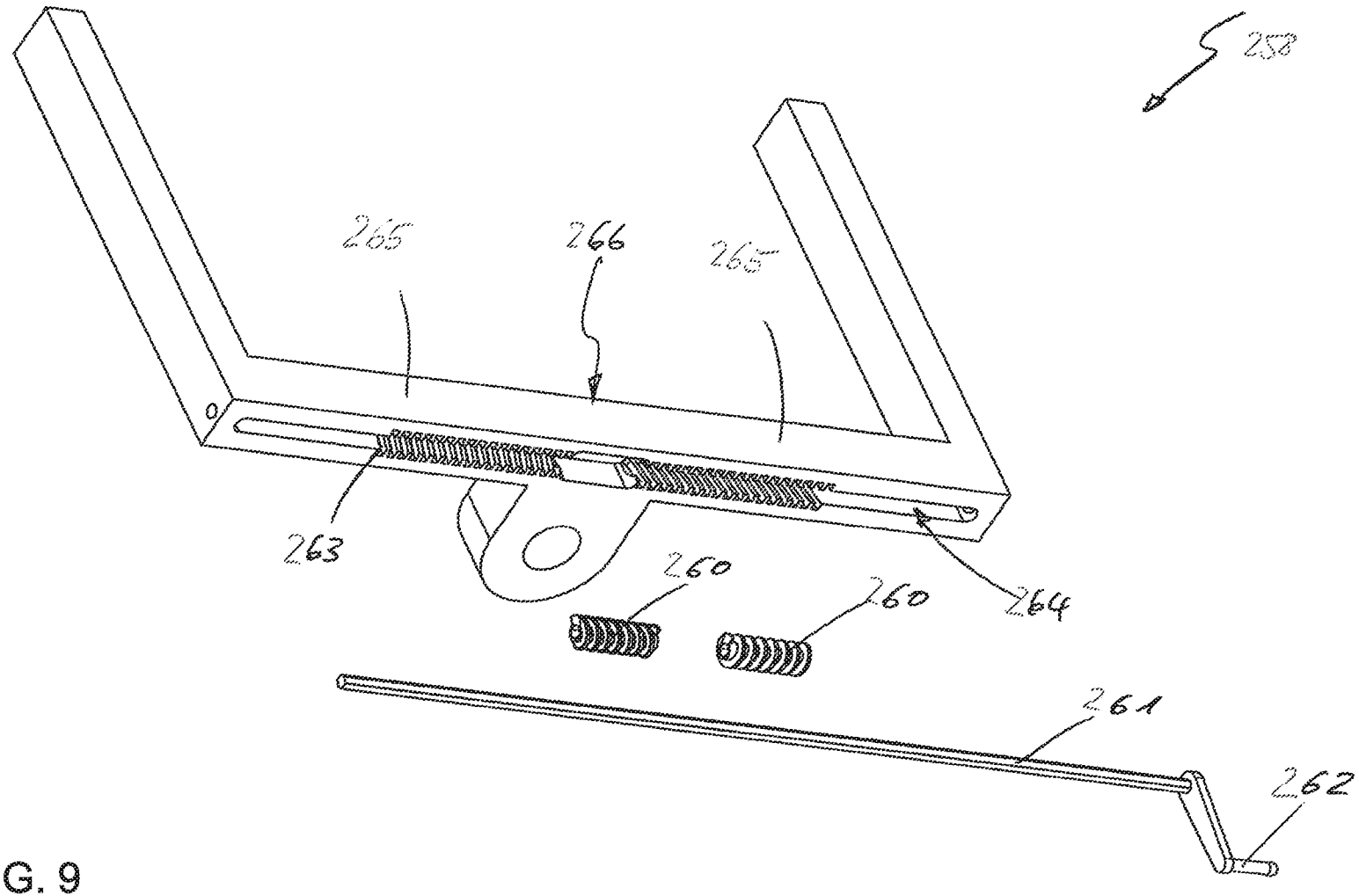
FIG. 9 shows a perspective exploded illustration of the basic support from FIG. 7.

FIGS. 7 to 9 show a basic support 258 which, by contrast with the basic support from FIG. 5, has a setting device 259. The setting device 259 comprises threaded pins 260 which can be rotated with an actuating shaft 261 via a crank 262 and are displaceable on the actuating shaft 261 in a longitudinal direction. The threaded pins 260 engage in transverse oblong holes 263 which are formed in an oblong hole 264 in torsion bar springs 265 of a transverse strut 266. Depending on the displacement of the threaded pins 260, a resistance torque of the torsion bar springs 265 can be changed, with the result that a spring constant or the torsion bar springs 265 can be set to be harder or softer.

Figure 10:
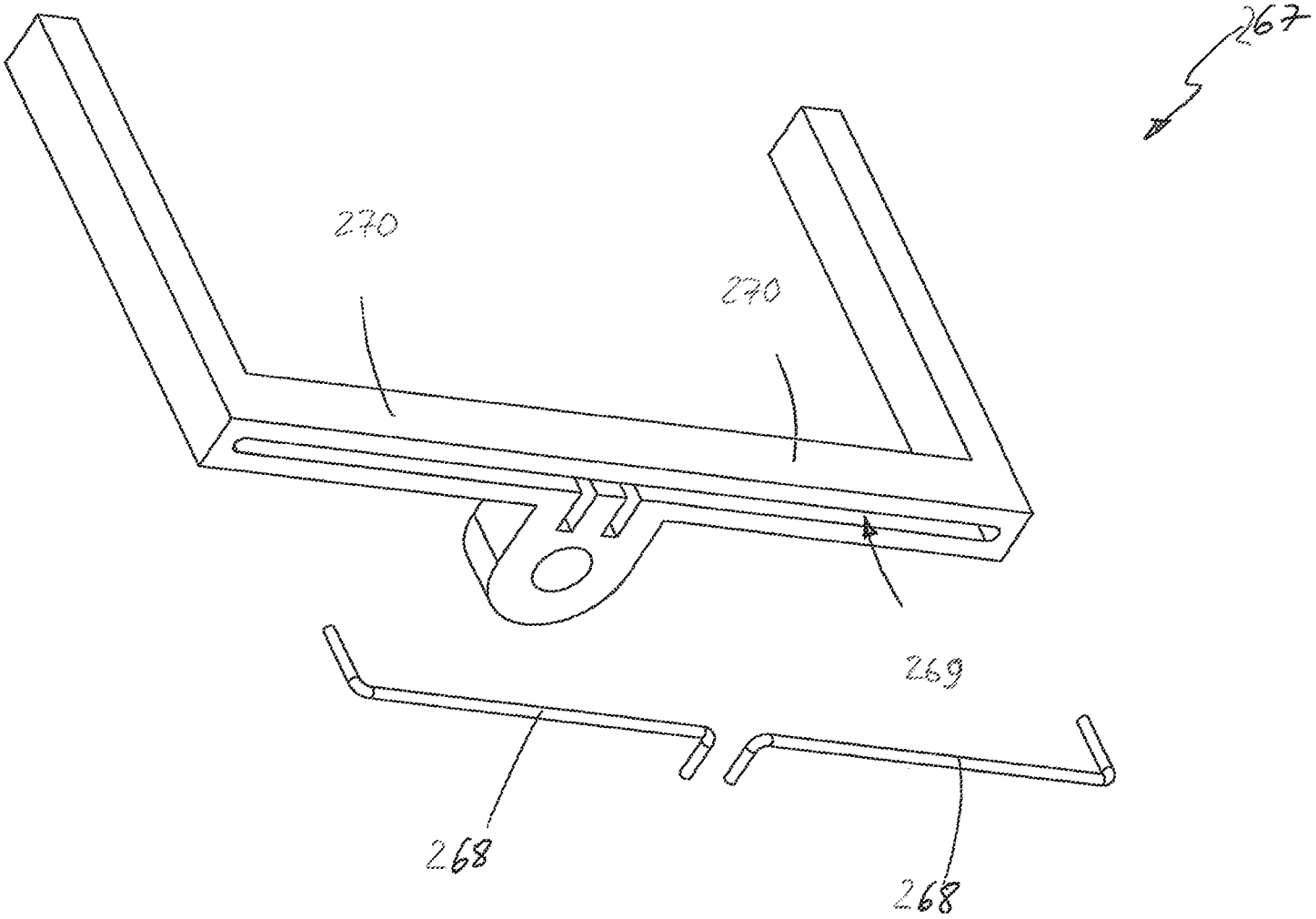
FIG. 10 shows a further development of the basic support from FIG. 5 in a perspective view.
Figure 11:
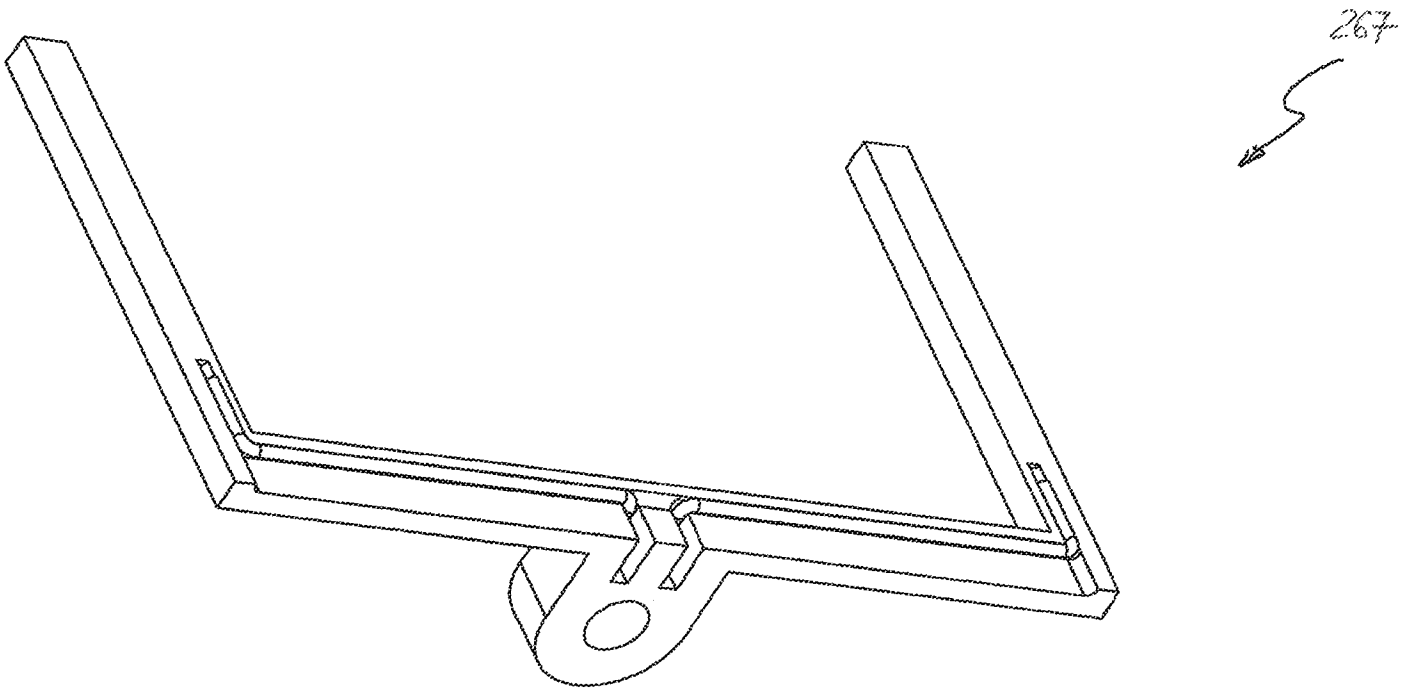
FIG. 11 shows a sectional illustration of the basic support from FIG. 10.

FIGS. 10 and 11 show a basic support 267 which, by contrast with the basic support from FIG. 9, has further torsion bar springs 268 made of spring steel. The further torsion bar springs 268 are inserted into an oblong hole 269 and fastened to the basic support 267 in a rotationally fixed manner. The arrangement of the further torsion bar springs 268 on the basic support 267 allows a spring constant of the thus formed torsion bar springs 270 to be substantially influenced.

Figure 12:
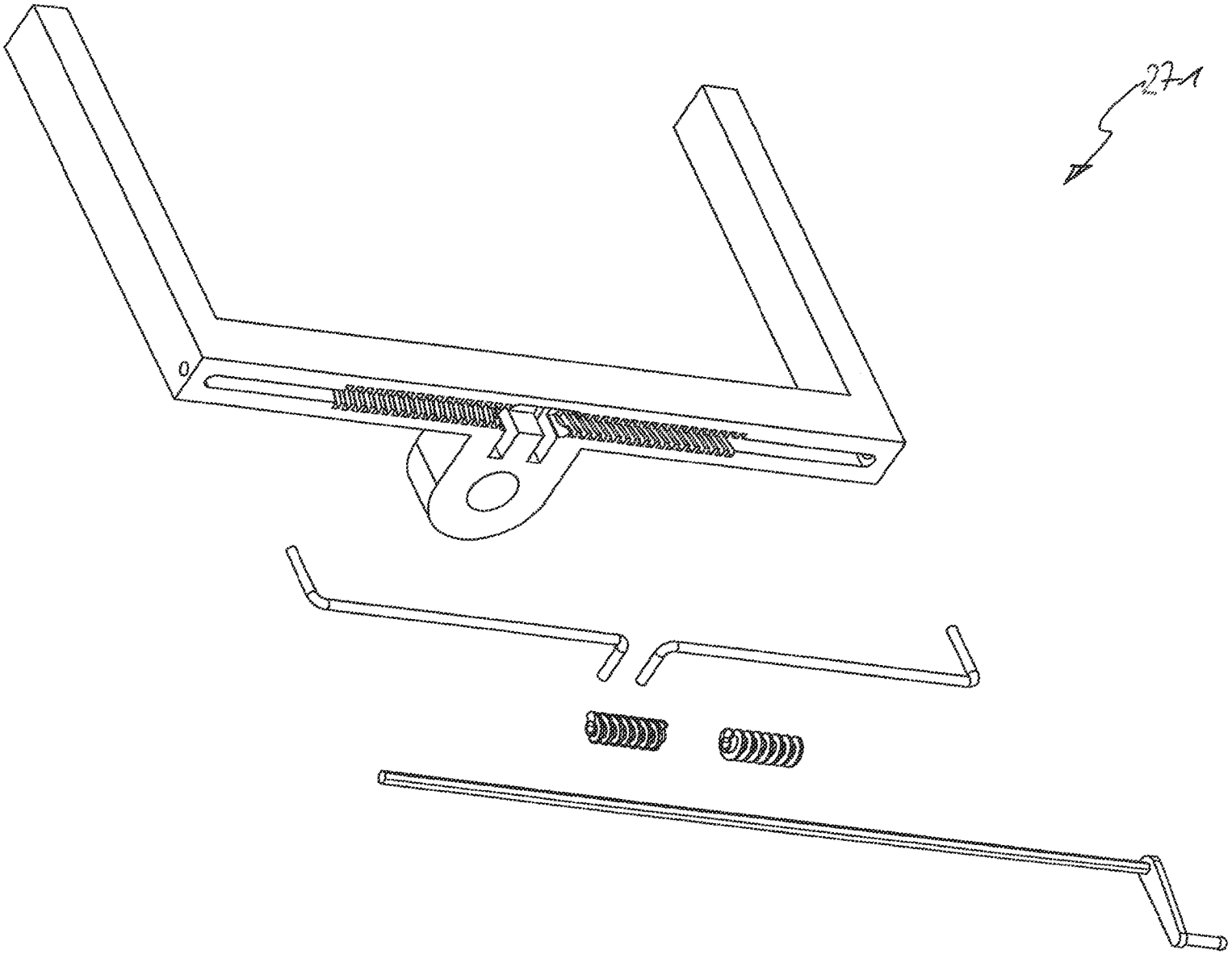
FIG. 12 shows a perspective exploded illustration of a further development of the basic support from FIG. 7.
Figure 13:
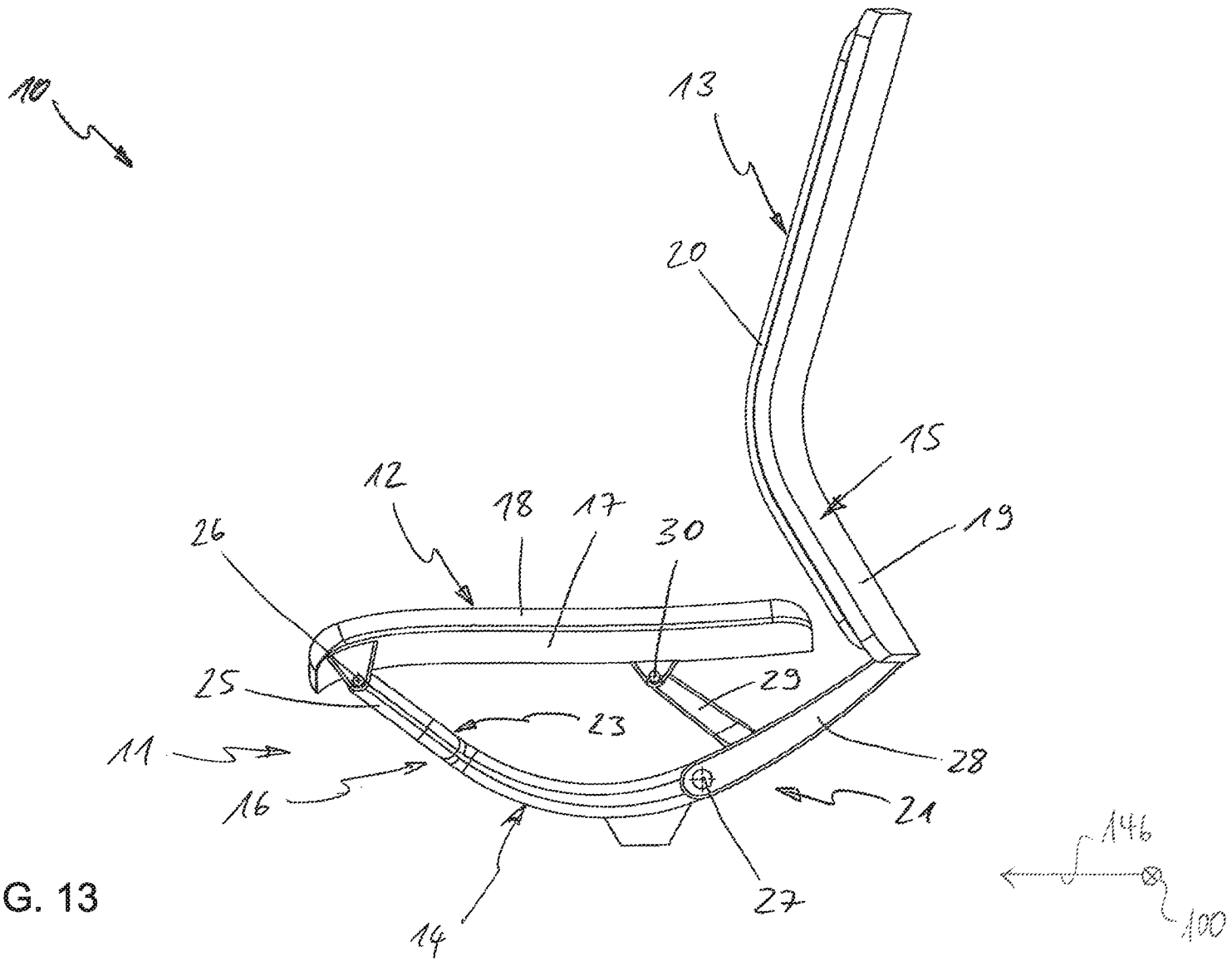
FIG. 13 shows a side view of a chair according to the invention (second embodiment)

FIG. 12 shows a basic support 271 which combines the basic supports described in relation to FIGS. 7 to 10.

With respect to the first embodiment of the invention that is described in conjunction with FIGS. 2 to 12, the solution according to the invention is distinguished in particular by the fact that what is concerned is a chair 232, in particular an office chair, which comprises a base frame with a base column 233 on which a seat element 235 and a seat backrest 236 are mounted via a seat inclination mechanism 234, wherein the seat inclination mechanism comprises a basic support 237, 250, 258, 267, 271 which is connected to the base column and to which a backrest support 240 and a seat element support are articulated, and the seat element and the seat backrest are connected to one another via a joint connection 221 of the seat inclination mechanism, wherein a transverse strut 238, 253, 266 of the seat inclination mechanism forms a spring device 251, wherein the transverse strut extends in the chair transverse direction 100 and is attached to the basic support, wherein the spring device has at least one torsion bar spring 239, 252, 265, 270, wherein the backrest support, together with the basic support and the torsion bar spring, is formed integrally, in particular in one piece, from plastic.

This chair is advantageously characterized in that the spring device 251 is formed with preloading.

This chair is advantageously characterized in that two torsion bar springs 239, 252, 265, 270 of the spring device 251 are integrally attached to the basic support 237, 250, 258, 267, 271 and, with respect to a vertical chair longitudinal center plane, are attached at their respective distal ends 255 to a lever 242, 256 of the seat inclination mechanism 234.

This chair is advantageously characterized in that the backrest support 240, together with the basic support 237, 250, 258, 267, 271 and the torsion bar springs 239, 252, 265, 270, is formed integrally, in particular in one piece, from plastic and forms the levers 242, 256 of the seat inclination mechanism 234.

This chair is advantageously characterized in that the seat element support is formed from struts 243 which are articulated to the basic support 237, 250, 258, 267, 271, and rear rotary joints 247 which are arranged on the levers 242, 256 and which hold the seat element 235.

This chair is advantageously characterized in that at least one front rotary joint 248 which is displaceable in an oblong hole 245 is formed between the struts 243 and the seat element 235, wherein a pivoting movement of the backrest support 240 on the torsion bar springs 239, 252, 265, 270 causes a displacement of the seat element 235 in the chair longitudinal direction relative to the basic support 237, 250, 258, 267, 271.

This chair is advantageously characterized in that the torsion bar spring 239, 252, 265, 270 is formed from a bar-shaped profile portion having an oblong hole 249, 254, 264, 269 which runs at least in certain portions in a longitudinal direction of the profile portion.

This chair is advantageously characterized in that the spring device has a setting device 259 for setting a spring constant of the torsion bar springs 265, 270, wherein the setting device is formed from support elements which are displaceable in the longitudinal direction in the oblong hole 264, 269.

This chair is advantageously characterized in that the support elements are formed in each case as a threaded pin 260 with an inner profile whose oppositely arranged threads engage in transverse oblong holes 263 formed in the oblong hole 264, 269, wherein the support elements are displaceable in the longitudinal direction of the oblong hole by means of a rotation of an actuating shaft 261, which is inserted in the inner profile, of the setting device 259.

This chair is advantageously characterized in that the spring device has for each torsion bar spring 270 a further torsion bar spring 268 made of spring steel, wherein the further torsion bar spring is inserted into the oblong hole 269 and is in each case fastened in a rotationally fixed manner at its proximal end to the basic support 267, 271 and at its distal end to the lever of the seat inclination mechanism.

With respect to the embodiment of the invention that is described in conjunction with FIGS. 2 to 12, the solution according to the invention is distinguished in particular by the fact that what is concerned is a seat inclination mechanism 234 for a chair 232, in particular an office chair, which comprises a basic support 237, 250, 258, 267, 271 which can be connected to a base column 233 of the chair, wherein two torsion bar springs 239, 252, 265, 270 of the seat inclination mechanism are integrally attached to the basic support and, with respect to a vertical chair longitudinal center plane, are attached at their respective distal ends 255 to a lever 242, 256 of the seat inclination mechanism, wherein a backrest support 240 of the chair, together with the basic support and the torsion bar springs, is formed integrally, in particular in one piece, from plastic and forms the levers of the seat inclination mechanism, wherein a seat element support of the chair is formed from struts 243, which are articulated on the basic support, and rear rotary joints 247 which are arranged on the levers and which hold the seat element 235, wherein at least one front rotary joint 248 which is displaceable in an oblong hole 245 is formed between the struts and the seat element, wherein a pivoting movement of the backrest support on the torsion bar springs 239, 252, 265, 270 causes a displacement of the seat element in the chair longitudinal direction relative to the basic support 237, 250, 258, 267, 271.

With respect to the embodiment of the invention that is described in conjunction with FIGS. 2 to 12, the solution according to the invention is distinguished in particular by the fact that what is concerned is a setting device 259 for a chair 232, in particular an office chair, wherein the setting device serves for setting a spring constant of torsion bar springs 265, 270 of a seat inclination mechanism of the chair, wherein the torsion bar springs are formed from a bar-shaped profile portion having an oblong hole 264, 269 which runs at least in certain portions in a longitudinal direction of the profile portion, wherein the setting device is formed from support elements which are displaceable in the longitudinal direction in the oblong hole, wherein the support elements are formed in each case as a threaded pin 260 with an inner profile whose oppositely arranged threads engage in transverse oblong holes 263 formed in the oblong hole, wherein the support elements are displaceable in the longitudinal direction of the oblong hole by means of a rotation of an actuating shaft 261, which is inserted in the inner profile, of the setting device 259.

A second embodiment of the invention will be described below. Here, the rotary joint 145 shown in FIG. 1 is replaced with the aid of a transverse strut according to the invention by a virtual rotary point.

FIGS. 13 to 16 schematically illustrate a chair 10 according to the invention which is formed as an office chair and which consequently can be adjusted in terms of its seat height, its seat depth and its inclination behavior.

The chair 10 comprises a base column (not shown in further detail) which is designed to be telescopable and at whose lower end there is arranged a roller cross formed in a customary manner.

On the base column there are arranged a seat inclination mechanism 11, a seat element 12 and a seat backrest 13 of the chair 10. The seat inclination mechanism 11 comprises a basic support 14 which is connected to the base column and on which a backrest support 15 and a seat element support 16 are articulated. The seat element 12 is formed from a seat shell 17 having a seat pad 18, and the seat backrest 13 is formed from a backrest shell 19 having a backrest pad 20.

Figure 14:
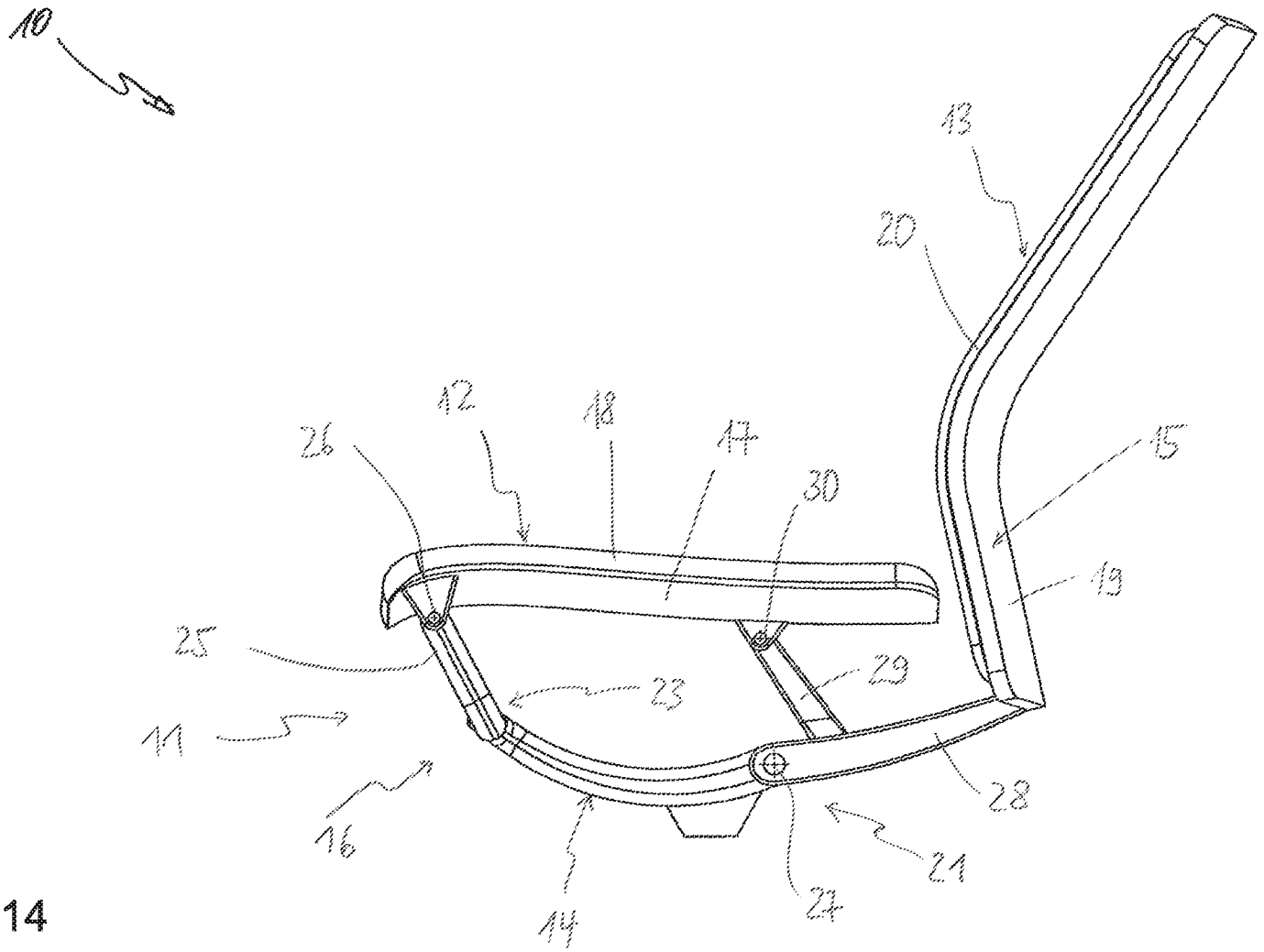
FIG. 14 shows a further side view of the chair from FIG. 13.
Figure 15:
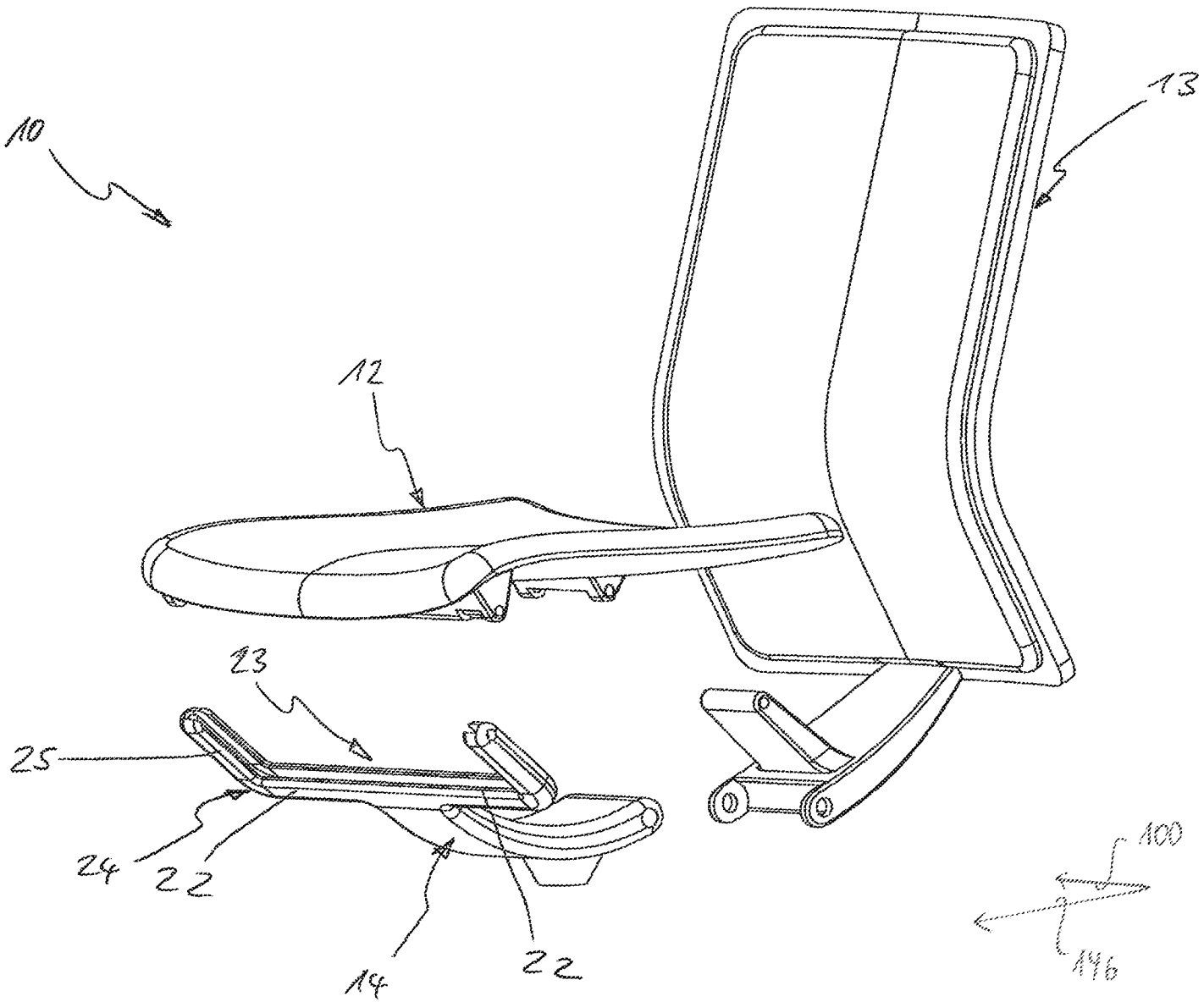
FIG. 15 shows a perspective exploded illustration of the chair from FIG. 13.
Figure 16:
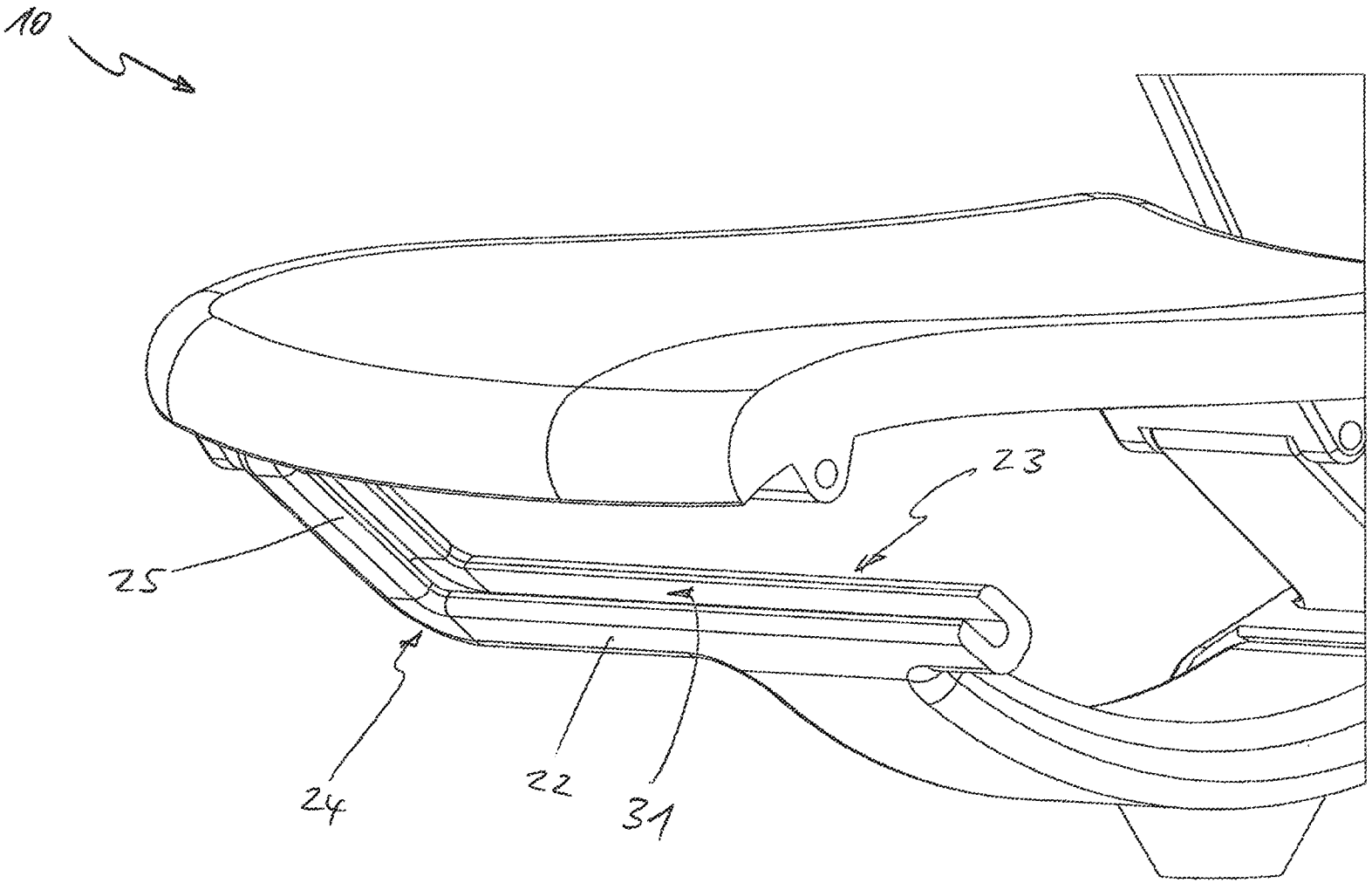
FIG. 16 shows a partial sectional view of the chair from FIG. 15.
Figure 17:
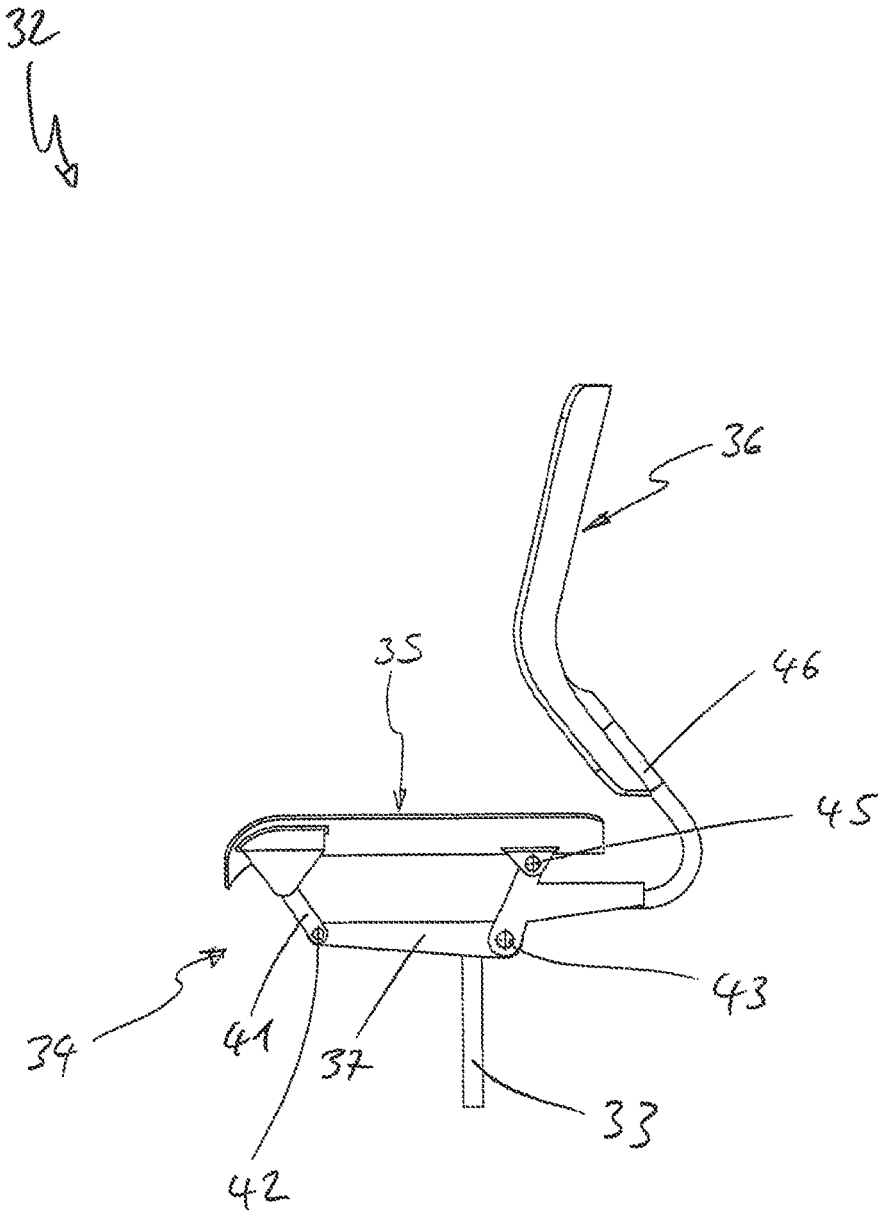
FIG. 17 shows a side view of a further chair according to the invention.

The seat element 12 is connected to the seat backrest 13 via a joint connection 21. The seat inclination mechanism 11 comprises two torsion bar springs 22 which are formed from a transverse strut 23. The torsion bar springs 22 are integrally formed on the basic support 14 and have levers 25 at outer, distal ends 24, said levers being attached to the seat shell 17 via a front rotary joint 26. Furthermore, a lower rotary joint 27 is formed on the basic support 14, via which rotary joint an extension 28 of the seat backrest 13 pivotably supports the seat backrest toward the rear, as illustrated in FIG. 14.

Furthermore, a strut 29 is integrally formed on the seat backrest 13 or on the extension 29 and is connected to the seat shell 17 via a rear rotary joint 30. As can be seen from FIG. 14, a rearwardly inclined seat backrest 13 on the lower rotary joint 27 leads to a displacement of the seat element 12, wherein the torsion bar springs 22 are twisted. The transverse strut 23, which forms the torsion bar springs 22, is formed with a slot 31 which runs in the longitudinal direction of the transverse strut 23 and which facilitates torsion of the transverse strut 23 or of the torsion bar springs 22. The chair 10 is essentially formed from the basic support 14, which is formed integrally, in particular in one piece, from plastic, the backrest support 15 and the seat shell 17 or the seat element support 16.

FIGS. 17 to 21 illustrate a chair 32 according to the invention which comprises a base column 33 with a roller cross (not shown in further detail), a seat inclination mechanism 34, a seat element 35, a seat backrest 36 and a basic support 37 which is connected to the base column 33. Here, too, a transverse strut 38 of the seat inclination mechanism 34 forms torsion bar springs 39.

Figure 18:
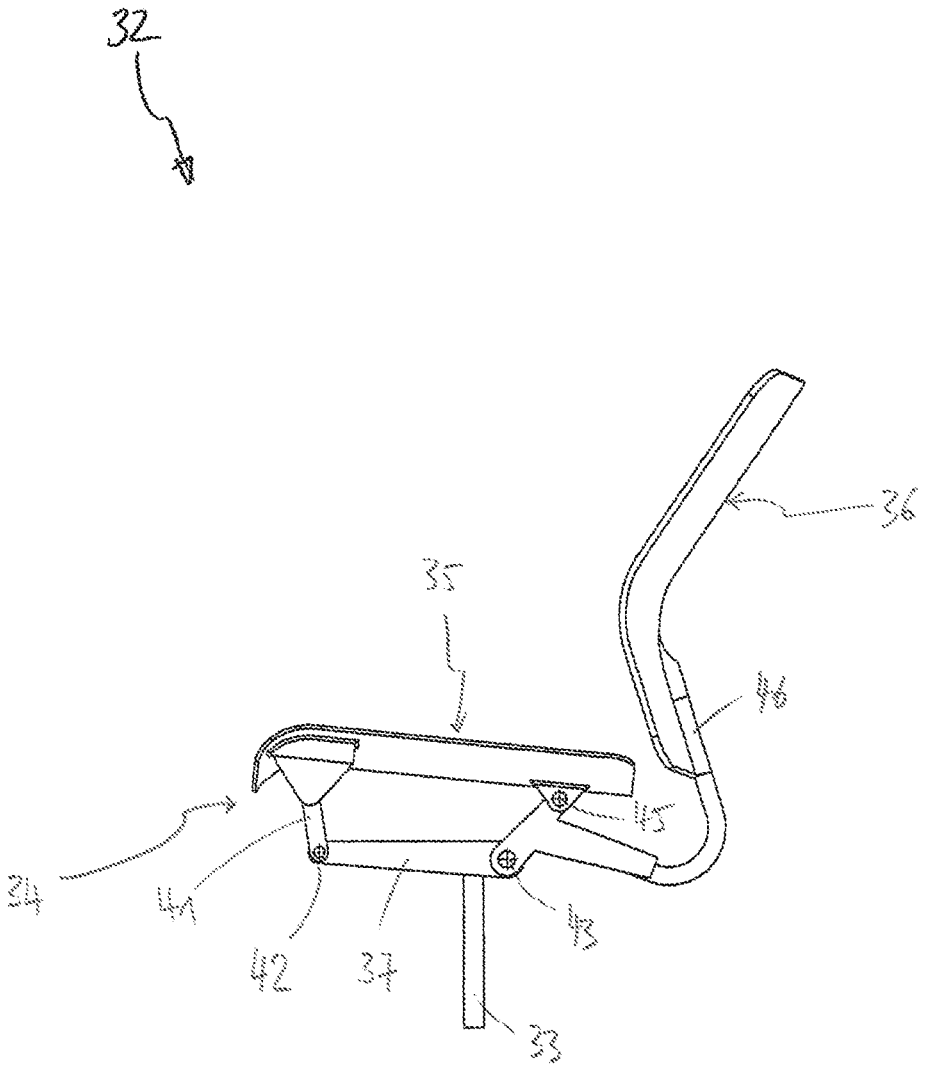
FIG. 18 shows a further side view of the chair from FIG. 17.
Figure 19:
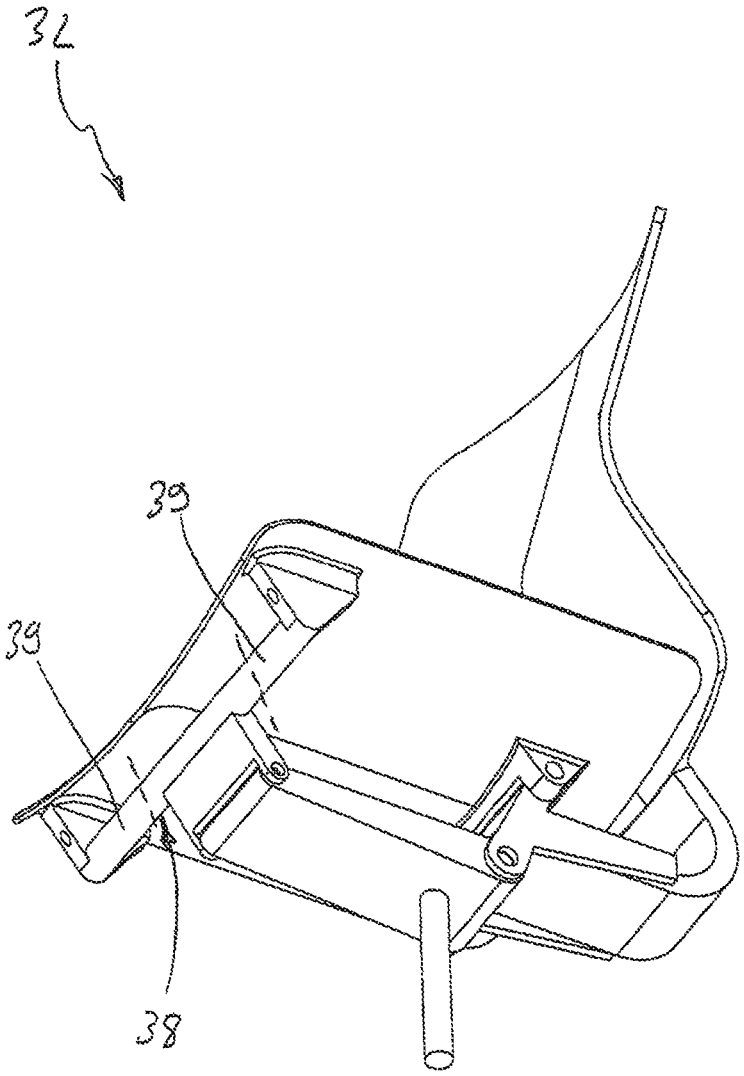
FIG. 19 shows a bottom view of the chair from FIG. 17.
Figure 20:
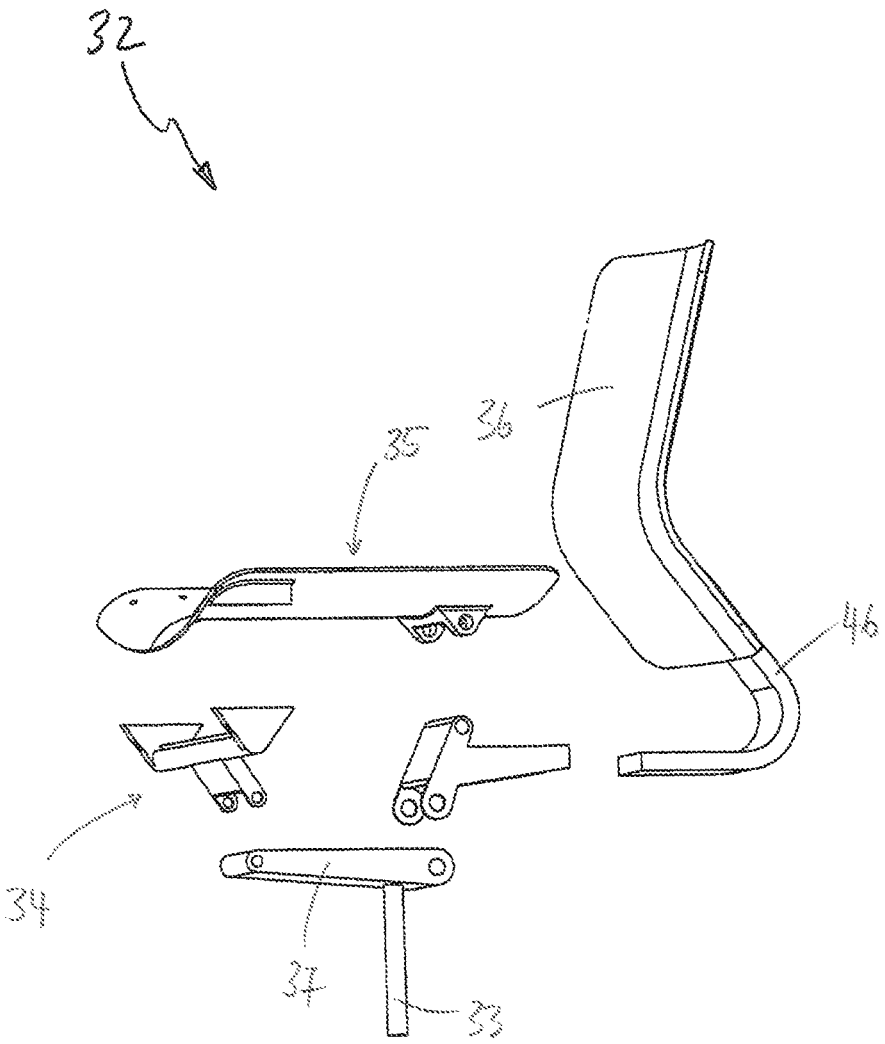
FIG. 20 shows a perspective exploded illustration of the chair from FIG. 17.
Figure 21:
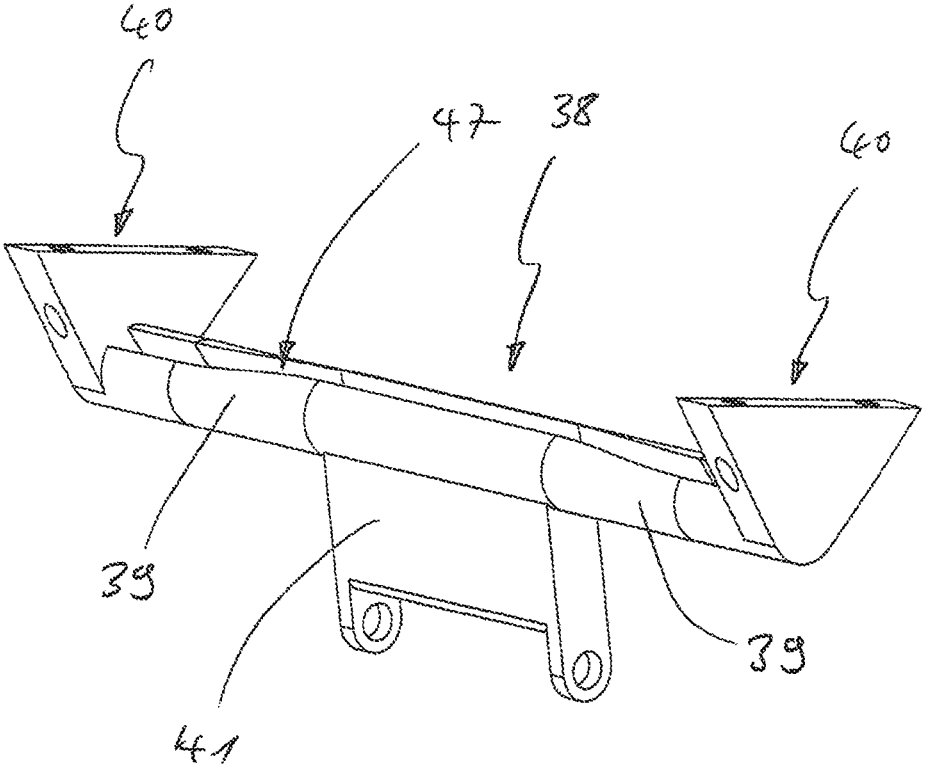
FIG. 21 shows a further perspective view of the cross-member from FIG. 20.
Figure 22:
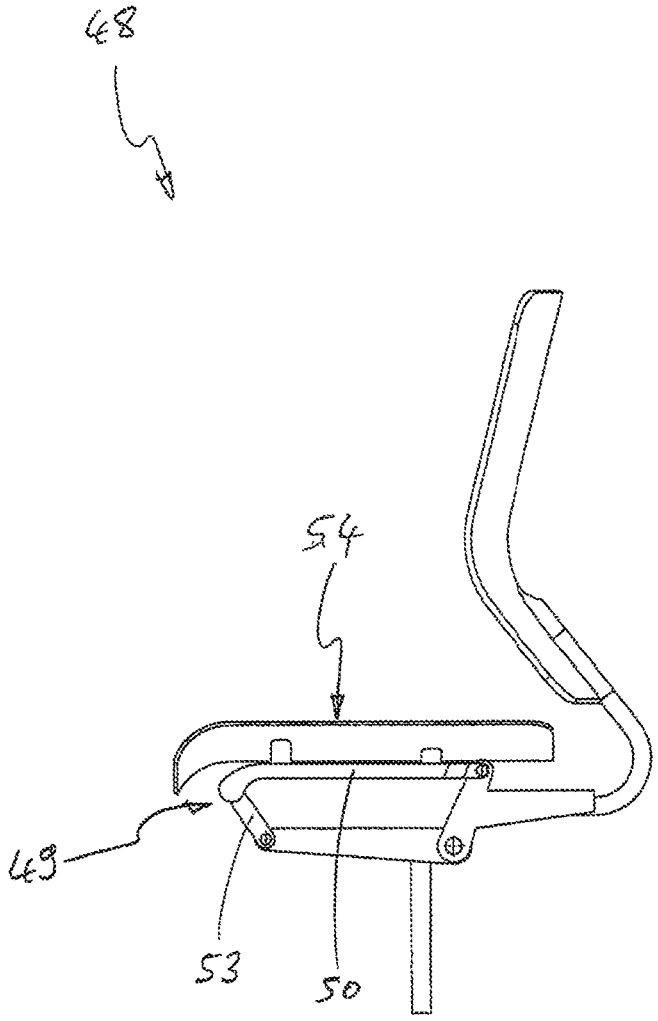
FIG. 22 shows a side view of a further chair according to the invention.
Figure 23:
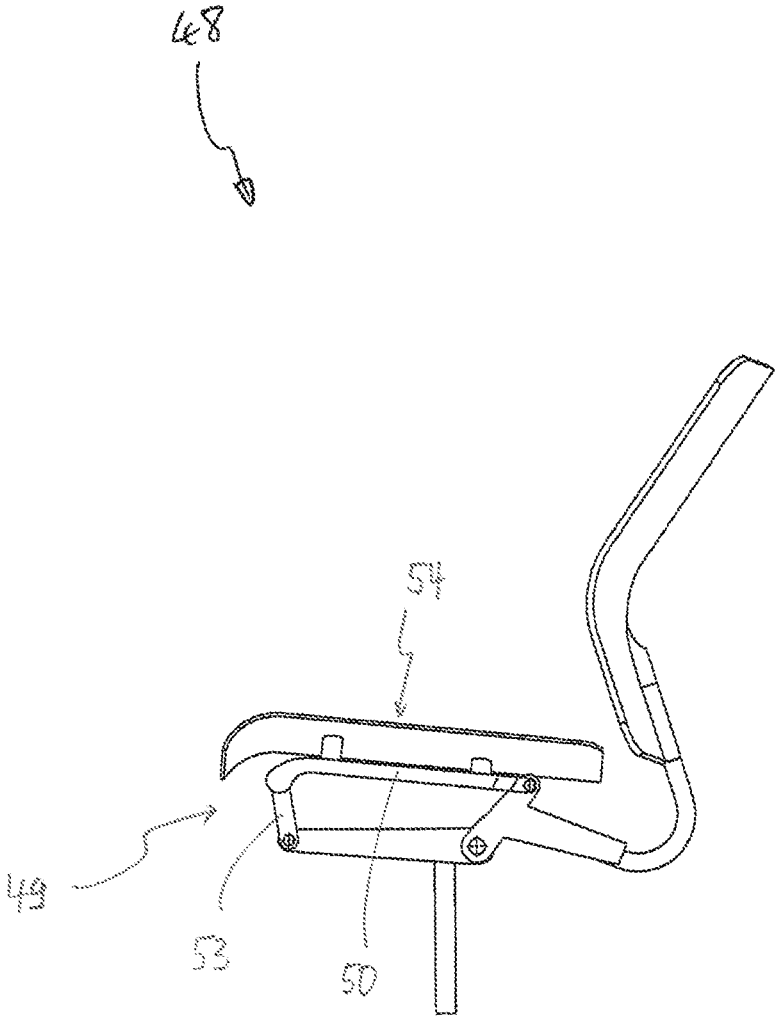
FIG. 23 shows a further side view of the chair from FIG. 22.
Figure 24:
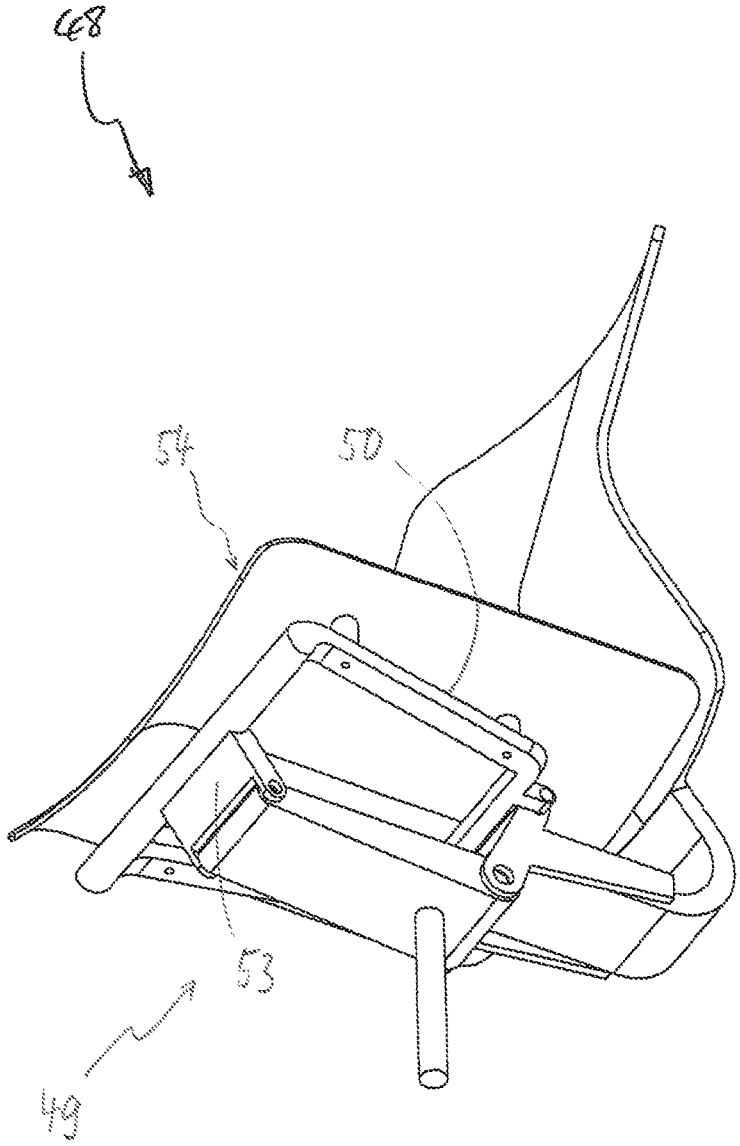
FIG. 24 shows a bottom view of the chair from FIG. 22.
Figure 25:
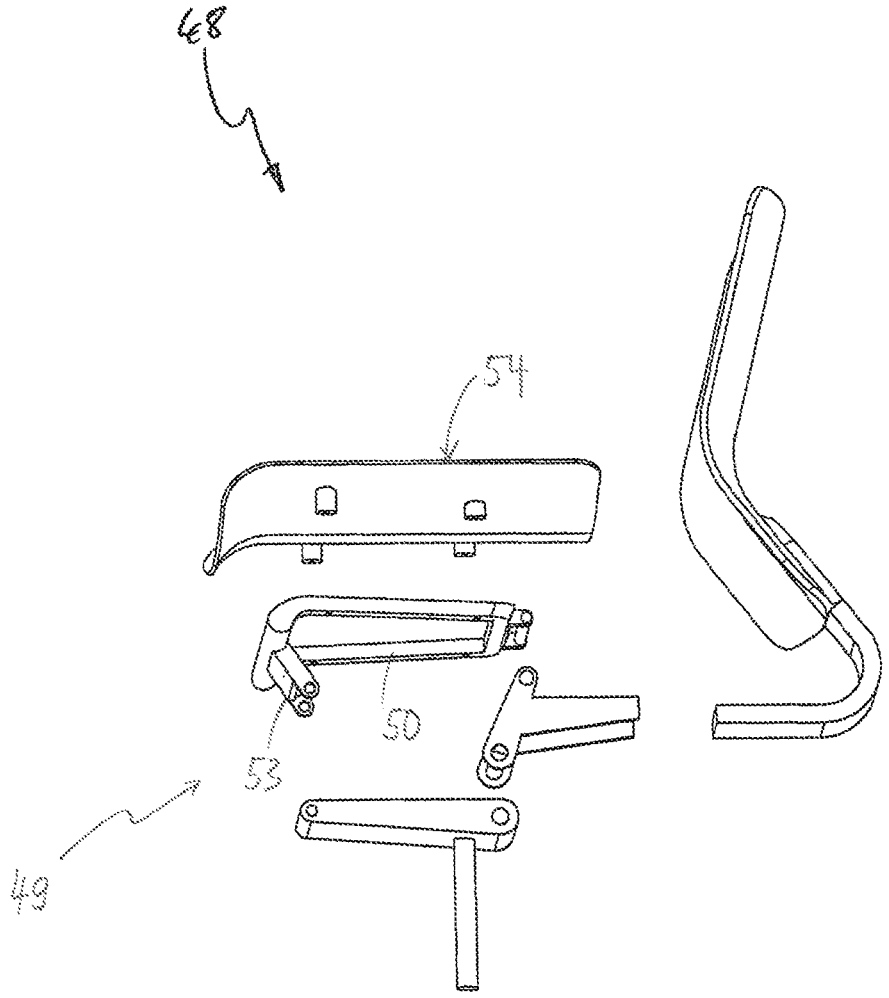
FIG. 25 shows a perspective exploded illustration of the chair from FIG. 22.
Figure 26:
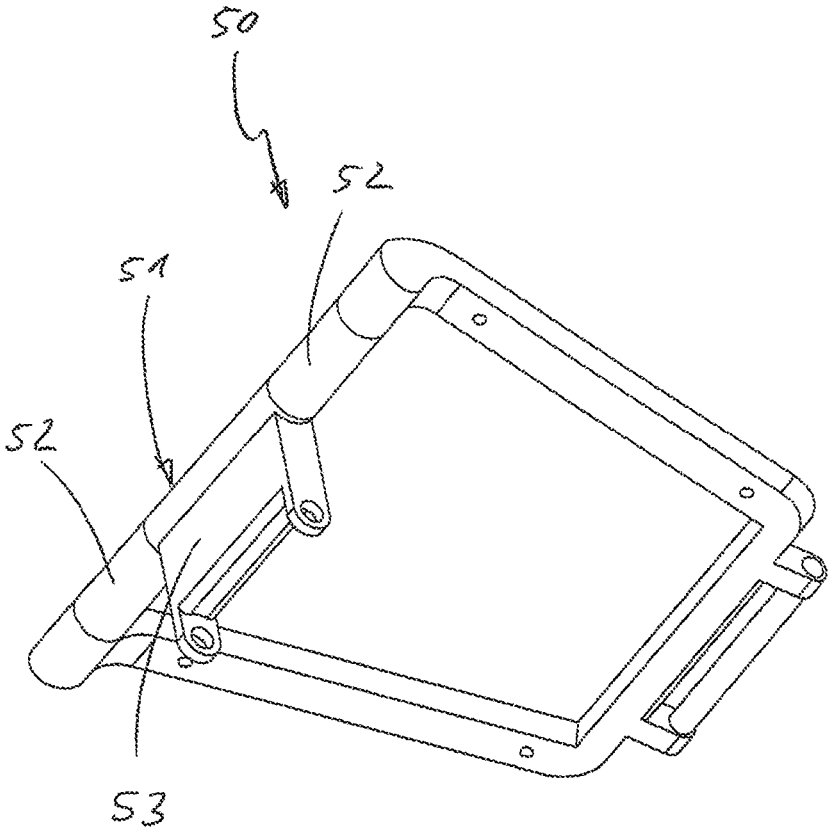
FIG. 26 shows a bottom view of a frame from FIG. 25.

Here, too, a transverse strut 38 of the seat inclination mechanism 34 forms torsion springs 39. Distal ends 40 of the torsion bar spring 39 are in each case screwed to the seat element 35 by means of screws (not shown in further detail here). A lever 41 is formed integrally, in particular in one piece, centrally on the torsion bar springs 39 or the transverse strut 38. The lever 41 is connected to the basic support 37 via a front rotary joint 42. Also formed on the basic support 37 is a lower rotary joint 43 together with an extension 44 of the seat backrest 36. Moreover, a rear rotary joint 45 together with the seat element 35 is formed on the extension 44. As can be seen in FIG. 18, a rearward inclination of the seat backrest 36 then causes a displacement of the seat element 35 in the chair longitudinal direction relative to the basic support 37. In the embodiment of the chair 32 as shown here, the extension of the seat backrest 36 is formed independently of a backrest support 46. Furthermore, a continuous oblong hole is formed in the transverse strut 38.

FIGS. 22 to 26 show a chair 48 in which, by contrast with the chair from FIGS. 17 to 21, a seat element support 49 is formed from a frame 50. The frame 50 forms a transverse strut 51 with the torsion bar springs 52. The frame 50 is in particular formed integrally, in particular in one piece, from plastic together with the torsion bar springs 52 and a lever 53, which is here integrally formed on the torsion bar springs 52. A seat element 54 is placed on and fastened to the frame 50.

With respect to the embodiment of the invention that is described in conjunction with FIGS. 13 to 26, the solution according to the invention is distinguished in particular by the fact that what is concerned is a chair 10, 32, 48, in particular an office chair, which comprises a base frame with a base column 33 on which a seat element 12, 35, 54 and a seat backrest 13, 36 are mounted via a seat inclination mechanism 11, 34, wherein the seat inclination mechanism comprises a basic support 14, 37 which is connected to the base column and on which a backrest support 15, 46 and a seat element support 16, 49 are articulated, and the seat element and the seat backrest are connected to one another via a joint connection 21 of the seat inclination mechanism, wherein a transverse strut 23, 38, 51 of the seat inclination mechanism forms a spring device, wherein the transverse strut extends in the chair transverse direction 100, wherein the spring device has at least one torsion bar spring 22, 39, 52, wherein the basic support or the seat element support, together with the torsion bar spring, is formed integrally, in particular in one piece, from plastic.

This chair is advantageously characterized in that the spring device is formed with preloading.

This chair is advantageously characterized in that two torsion bar springs 22 of the spring device are integrally formed on the basic support 14 and, with respect to a vertical chair longitudinal center plane, are attached at their respective distal ends 24 to a lever 25 of the seat inclination mechanism 11.

This chair is advantageously characterized in that the basic support 14, together with the torsion bar springs 22, is formed integrally, in particular in one piece, from plastic and forms the levers 25 of the seat inclination mechanism 11.

This chair is advantageously characterized in that the backrest support 15 is connected to the basic support 14 via a lower rotary joint 27.

This chair is advantageously characterized in that the seat element support 16 is formed from at least one strut 29, which is articulated on the backrest support 15, and the levers 25 which hold the seat element 12.

This chair is advantageously characterized in that a rear rotary joint 30 is formed between the strut 29 and the seat element 12, and the levers 25 are connected to the seat element via in each case a front rotary joint 26, wherein a pivoting movement of the backrest support 15 on the lower rotary joint 27 causes a displacement of the seat element in the chair longitudinal direction relative to the basic support 14.

In a further embodiment, the above-described chair can advantageously be characterized in that, with respect to a vertical chair longitudinal center plane, two torsion bar springs 39 of the spring device are attached at their respective distal ends 40 to the seat element 35 and are attached, via a lever 41, which is formed integrally with the torsion bar springs, to a front rotary joint 42 of the seat inclination mechanism on the basic support 37. In this case, this chair is also advantageously characterized in that the distal ends 40 of the torsion bar springs 39 are screwed to or integrally formed on the seat element 35 and/or this chair is characterized in that a rear rotary joint 45 is formed between the seat element support and the seat element 35, and the lever 41 is connected to the basic support 37 via the front rotary joint 42, wherein a pivoting movement of the backrest support 46 on the lower rotary joint 43 causes a displacement of the seat element in the chair longitudinal direction relative to the basic support.

In a further embodiment, the above-described chair can advantageously be characterized in that the seat element support 49 is formed from a frame 50 which forms the transverse strut 51, wherein, with respect to a vertical chair longitudinal center plane, two torsion bar springs 52 of the spring device are attached at their respective distal ends to the frame and are attached, via a lever 53, which is integrally formed with the torsion bar springs, to a front rotary joint 42 of the seat inclination mechanism on the basic support 37. In this case, this chair is advantageously also characterized in that a rear rotary joint 45 is formed at a rear end of the frame 50, and the backrest support 46 is connected to the seat element support 49 via the rear rotary joint, wherein a pivoting movement of the backrest support on the lower rotary joint 43 causes a displacement of the seat element 54 in the chair longitudinal direction relative to the basic support 37.

In a further embodiment, the above-described chair can advantageously be characterized in that the torsion bar spring 22 is formed from a bar-shaped profile portion having an oblong hole 31 which runs at least in certain portions in a longitudinal direction of the profile portion. In this case, this chair is advantageously also characterized in that the spring device has for each torsion bar spring a further torsion bar spring made of spring steel, wherein the further torsion bar spring is inserted into the oblong hole and is in each case fastened in a rotationally fixed manner at its proximal end to the basic support or the seat element support and at its distal end to the lever of the seat inclination mechanism.

With respect to the embodiment of the invention as described in conjunction with FIGS. 13 to 26, the solution according to the invention is distinguished in particular by the fact that what is concerned is a seat inclination mechanism 11, 34 for a chair 10, 32, 48, in particular an office chair, said mechanism comprising a basic support 14, 37, which can be connected to a base column 33 of the chair, an extension 28, 44, which is articulated on the basic support, of a backrest support 15, 46 of the chair, and a seat element support 16, 49, wherein two torsion bar springs 22, 39, 52 are integrally attached to the basic support or the seat element support and, with respect to a vertical chair longitudinal center plane, are attached at their respective distal ends 24, 40 to a lever 25 of the seat inclination mechanism or to the seat element support, wherein the extension is connected to the basic support via a lower rotary joint 27, 43, wherein the seat element support is formed from at least the extension and the lever, which holds the seat element, wherein a rear rotary joint 30, 45 is formed between the extension and the seat element, and the lever is connected to the seat element or the seat element support via in each case a front rotary joint 26, 42, wherein a pivoting movement of the backrest support with the extension on the lower rotary joint causes a displacement of the seat element in the chair longitudinal direction relative to the basic support.

What applies to all embodiments is that a seat element support in the broader sense is to be understood to mean a part which supports or holds the seat element. If the seat element consists, on the one hand, of a seat frame or a seat shell or the like and, on the other hand, of a pad, a cover or the like, in preferred embodiments a seat element support then also comprises, in the narrower sense, the seat frame or the seat shell, since these parts also exert a supporting or holding function for the actual seat surface. The seat element support is always articulated on the basic support. According to the basic construction illustrated in FIG. 1, the term "seat element support" can for example comprise the seat frame 3 and/or the front coupling element 141. In the case of the chair 232, as illustrated in FIGS. 2 to 4, the seat shell 244 and/or the front rotary joint 248 serve/serves for example as seat element support. In the case of the chairs 10, 32 as shown in FIGS. 13 to 26, the seat element supports 16, 49 are provided, for example. It is also possible there for the seat shell 17 or the seat frame 50 to serve as seat element support.

The positions of the rotary points relative to one another and relative to other construction elements of the mechanism, these positions being stated in conjunction with the above-described exemplary embodiments of individual seat inclination mechanisms, are to be understood merely as examples of concrete advantageous variants of the invention. The invention can also be applied to seat inclination mechanisms which have a different arrangement of the rotary points.

All design and functional features, properties and advantages explained for an exemplary embodiment of the invention in connection with transverse struts having spring devices can also be applied to the other exemplary embodiments.

All the features presented in the description, in the following claims and the drawing may be essential to the invention both individually and in any desired combination with one another.

LIST OF REFERENCE SIGNS

1 Basic support
2 Base column
3 Seat element support, seat frame
4 Backrest support
7 Pivoting direction
10 Chair
11 Seat inclination mechanism
12 Seat element
13 Seat backrest
14 Basic support
15 Backrest support
16 Seat element support
17 Seat shell
18 Seat pad
19 Backrest shell
20 Backrest pad
21 Joint connection
22 Torsion bar spring
23 Transverse strut
24 Distal end
25 Lever
26 Front rotary joint
27 Rear rotary joint
28 Extension
29 Strut
30 Rear rotary joint
31 Oblong hole
32 Chair
33 Base column
34 Seat inclination mechanism
35 Seat element
36 Seat backrest

37 Basic support
38 Transverse strut
39 Torsion bar spring
40 Distal end
41 Lever
42 Front rotary joint
43 Lower rotary joint
44 Extension
45 Rear rotary joint
46 Backrest support
47 Oblong hole
48 Chair
49 Seat element support
50 Frame
51 Transverse strut
52 Torsion bar spring
53 Lever
54 Seat element
100 Chair transverse direction
139 Synchronous mechanism
140 Rear coupling element
141 Seat element support, front coupling element
142 First rotary joint
143 Second rotary joint
144 Third rotary joint
145 Fourth rotary joint
146 Chair longitudinal direction
232 Chair
233 Base column
234 Seat inclination mechanism
235 Seat element
236 Seat backrest
237 Basic support
238 Transverse strut
239 Torsion bar spring
240 Backrest support
241 Leg
242 Lever
243 Strut
244 Seat shell
245 Oblong hole
246 Axle
247 Rear rotary joint
248 Front rotary joint
249 Oblong hole
250 Basic support
251 Spring device
252 Torsion bar spring
253 Transverse strut
254 Oblong hole
255 Distal end
256 Lever
257 Flange
258 Basic support
259 Setting device
260 Threaded pin
261 Actuating shaft
262 Crank
263 Transverse oblong hole
264 Oblong hole
265 Torsion bar spring
266 Transverse strut
267 Basic support
268 Further torsion bar spring
269 Oblong hole
270 Torsion bar spring
271 Basic support

The invention claimed is:

1. A chair, comprising:

a seat element;

a seat element support;

a seat backrest having a backrest support;

a seat inclination mechanism;

a base frame having a base column on which said seat element and said seat backrest are mounted via said seat inclination mechanism; and said seat inclination mechanism having a joint connection and a basic support connected to said base column and on which said backrest support and said seat element support are articulated, and said seat element and said seat backrest are connected to one another via said joint connection of said seat inclination mechanism, said seat inclination mechanism having a transverse strut forming a spring device, wherein said transverse strut extending in a chair transverse direction and wherein said spring device having at least one torsion element, and wherein said at least one torsion element, together with said basic support or said seat element support, are formed in one piece, from plastic.

2. The chair according to claim 1, wherein:

said seat inclination mechanism has a lever; and said at least one torsion element is one of two torsion elements of said spring device, which are integrally attached to said basic support and, with respect to a vertical chair longitudinal center plane, are attached at their respective distal ends to said lever of said seat inclination mechanism.

3. The chair according to claim 2, wherein said torsion elements are attached to said basic support and, together with said backrest support and said basic support, are formed in one piece.

4. The chair according to claim 3, wherein:

said torsion elements are torsion bar springs;

said backrest support, together with said basic support and said torsion bar springs, are formed in one piece, from plastic and form levers of said seat inclination mechanism, in such a way that said seat element support is formed from struts, which are articulated on said basic support, and rear rotary joints, which are disposed on said levers and which hold said seat element.

5. The chair according to claim 4, wherein said backrest support, together with said basic support and said torsion bar springs, are formed integrally.

6. The chair according to claim 2, wherein said two torsion elements of said spring device are torsion bar springs.

7. The chair according to claim 3, wherein said torsion elements are attached to said basic support and, together with said backrest support and said basic support, is formed integrally.

8. The chair according to claim 1, wherein said at least one torsion element is one of two torsion elements being two torsion bar springs;

wherein said basic support, together with said torsion bar springs, are formed in one piece, from plastic and forms levers of said seat inclination mechanism;

further comprising a lower rotary joint; and wherein said backrest support is connected to said basic support via said lower rotary joint.

9. The chair according to claim 8, wherein said basic support, together with said torsion bar springs, are formed integrally; and wherein said backrest support is connected to said basic support via said lower rotary joint in such a way that said seat element support is formed from at least one strut, which is articulated on said backrest support, and levers which hold said seat element.

10. The chair according claim 1, wherein said at least one torsion element is one of two torsion elements being two torsion bar springs;

further comprising a lever formed integrally with said torsion bar springs;

wherein said seat inclination mechanism has a front rotary joint; and wherein with respect to a vertical chair longitudinal center plane, said torsion bar springs of said spring device are attached at their respective distal ends to said seat element and are attached, via said lever formed integrally with said torsion bar springs, to said front rotary joint of said seat inclination mechanism on said basic support.

11. The chair according claim 10, further comprising a lever formed integrally with said torsion bar springs;

wherein said seat inclination mechanism has a front rotary joint; and wherein with respect to the vertical chair longitudinal center plane, said torsion bar springs of said spring device are attached at their respective distal ends to said seat element and are attached, via said lever formed integrally with said torsion bar springs, to said front rotary joint of said seat inclination mechanism on said basic support, in such a way that said distal ends of said torsion bar springs are screwed to or integrally formed on said seat element.

12. The chair according to claim 1, wherein:

said seat element support is formed from a frame which forms said transverse strut;

said seat inclination mechanism has a front rotary joint; and said at least one torsion element is one of two torsion elements being torsion bar springs having a lever formed integrally therein, wherein with respect to a vertical chair longitudinal center plane, said two torsion bar springs of said spring device are attached at their respective distal ends to said frame and are attached, via said lever formed integrally with said torsion bar springs, to said front rotary joint of said seat inclination mechanism on said basic support.

13. The chair according to claim 12, further comprising a rear rotary joint being formed at a rear end of said frame, and said backrest support is connected to said seat element support via said rear rotary joint, wherein a pivoting movement of said backrest support on said lower rotary joint causes a displacement of said seat element in the chair longitudinal direction relative to said basic support.

14. The chair according to claim 1, wherein:

the chair is an office chair; and said at least one torsion element is a torsion bar spring.

15. A seat inclination mechanism for a chair, the seat inclination mechanism comprising:

a backrest support;

a seat element support;

a basic support on which said backrest support and said seat element support are articulated; and a transverse strut of the seat inclination mechanism forming a spring device, said transverse strut extending in a chair transverse direction and said spring device having at least one torsion element, and said at least one torsion element, together with said basic support or said seat element support, is formed in one piece, from plastic.

16. The seat inclination mechanism according to claim 15, wherein said a least one torsion element is a torsion bar spring, and said at least one torsion element, together with at least one of said basic support, said backrest support or said seat element support, is formed integrally.

* * * * *